US010203618B2

(12) United States Patent
Takigaura et al.

(10) Patent No.: US 10,203,618 B2
(45) Date of Patent: Feb. 12, 2019

(54) ELECTROSTATIC CHARGE IMAGE DEVELOPING TONER

(71) Applicant: Konica Minolta, Inc., Tokyo (JP)

(72) Inventors: Yusuke Takigaura, Hino (JP); Takaki Kawamura, Hino (JP); Shiro Hirano, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/881,065

(22) Filed: Jan. 26, 2018

(65) Prior Publication Data

US 2018/0217515 A1 Aug. 2, 2018

(30) Foreign Application Priority Data

Feb. 2, 2017 (JP) ..... 2017-017189

(51) Int. Cl.
*G03G 9/08* (2006.01)
*G03G 9/087* (2006.01)

(52) U.S. Cl.
CPC ..... *G03G 9/08711* (2013.01); *G03G 9/08755* (2013.01); *G03G 9/08795* (2013.01); *G03G 9/08797* (2013.01)

(58) Field of Classification Search
CPC ..... G03G 9/08755; G03G 9/08711; G03G 9/08795; G03G 9/08797
USPC ..... 430/109.4, 111.4
See application file for complete search history.

(56) References Cited

FOREIGN PATENT DOCUMENTS

JP 2014195850 A 10/2014

*Primary Examiner* — Mark A Chapman
(74) *Attorney, Agent, or Firm* — Lucas & Mercanti, LLP

(57) ABSTRACT

An electrostatic charge image developing toner includes a binder resin and a release agent. A ratio of a crystalline polyester resin to the total amount of a amorphous polyester resin and the crystalline polyester resin is within a range exceeding 40% by mass to 60% by mass. A temperature at which a storage modulus before heat left G' before being left to stand at a temperature of X° C. becomes $1.0\times10^8$ Pa is within a range exceeding 45° C. to 55° C. A storage modulus after heat left G' at a temperature of X'° C. at which a value of a ratio of the storage modulus after heat left G' at a temperature of X° C. after being left to stand at the temperature of X° C. for 2 hours to the storage modulus before heat left G' at the temperature of X° C. becomes the maximum is within a range of $1.0\times10^8$ to $5.0\times10^8$ Pa.

8 Claims, 2 Drawing Sheets

ELECTROSTATIC CHARGE IMAGE DEVELOPING TONER

BACKGROUND

1. Technological Field

The present invention relates to an electrostatic charge image developing toner. More specifically, the present invention relates to an electrostatic charge image developing toner that is excellent in the low temperature fixability and the heat-resistant storability, and further can suppress the generation of gloss memory.

2. Description of the Related Art

In recent years, in an electrophotographic image forming device, in order to achieve high-speed printing and energy saving, development of an electrostatic charge image developing toner (hereinafter, also referred to as "toner") in which the low temperature fixability is further improved has been demanded. Such a toner can be realized, for example, by adding a crystalline polyester resin having a sharp melt property into a binder resin to lower the melting temperature or melt viscosity of the binder resin.

However, with the toner containing a crystalline material, the low temperature fixability improves, further the plasticization progresses, and as a result, the heat-resistant storability is lowered. For this reason, when continued to be exposed to high temperatures in an image forming device, the toner may be aggregated, and the print image quality may be deteriorated in some cases.

In order to cope with such a problem, from the past, as disclosed in, for example, JP 2014-195850 A, a technique for optimizing the compatibility between the crystalline polyester resin and the amorphous polyester resin by adjusting the ratio or solubility parameter (SP) value of the crystalline polyester resin and the amorphous polyester resin has been proposed. In this way, the storage modulus G' of the toner is increased, therefore, the toner is hardly aggregated even in a high-temperature image forming device. That is, the heat-resistant storability of the toner is improved.

However, when attempting to achieve both of the low temperature fixability and the heat-resistant storability by using such a measure, it becomes necessary to increase the ratio of the amorphous polyester in the toner. Consequently, the release agent, which is contained in the toner for the purpose of facilitating the peeling of the toner from a fixing roller, is compatible with the amorphous polyester, and is easily localized. As a result, when fixing the toner onto a recording medium, the discharge of the release agent from the toner particles is hindered, and when the fixing roller rotates once and comes into contact with the next recording medium, there occurs a phenomenon called gloss memory in which gloss unevenness corresponding to a pattern of the previously printed image is generated.

SUMMARY

The present invention has been made in view of the above problems and situations, the problem to be solved is to provide an electrostatic charge image developing toner containing an amorphous polyester resin, and a crystalline polyester resin, which is excellent in the low temperature fixability and the heat-resistant storability, and further can suppress the generation of gloss memory.

In order to solve the problem described above, in the course of examination of the cause and the like of the above problems, the present inventors have found that the above-described problem can be solved by containing a styrene-acrylic resin, and further by adjusting the content of the crystalline polyester resin, and adjusting the storage modulus G' under specific conditions, and thus have completed the present invention.

That is, the problems described above are solved by the following means.

To achieve at least one of the abovementioned objects, according to an aspect of the present invention, there is provided an electrostatic charge image developing toner at least including:

an amorphous polyester resin, a crystalline polyester resin, and a styrene-acrylic resin, as a binder resin; and a release agent, wherein a ratio of the crystalline polyester resin to the total amount of the amorphous polyester resin and the crystalline polyester resin is within a range exceeding 40% by mass to 60% by mass, a temperature at which a storage modulus before heat left G' before being left to stand at a temperature of X° C. becomes $1.0\times10^8$ Pa is within a range exceeding 45° C. to 55° C., and a storage modulus after heat left G' at a temperature of X'° C. at which a value of a ratio of the storage modulus after heat left G' at a temperature of X° C. after being left to stand at the temperature of X° C. for 2 hours to the storage modulus before heat left G' at the temperature of X° C. becomes the maximum is within a range of $1.0\times10^8$ to $5.0\times10^8$ Pa.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Although the development mechanism of the effect of the present invention is not clear at the moment, it is presumed as follows.

It is considered that the reason why the low temperature fixability and the heat-resistant storability both can be achieved according to the present invention is because by setting the ratio of the crystalline polyester resin to the total amount of the amorphous polyester resin and the crystalline polyester resin to be within the range exceeding 40% by mass to 60% by mass, the amount of the crystalline polyester being present incompatible in the toner after being heat-left to stand becomes an appropriate amount.

In addition, it is considered to be one reason that the temperature at which a storage modulus before heat left G' becomes $1.0\times10^8$ Pa is set to be within the range exceeding 45° C. to 55° C., and also that the storage modulus after heat left G' at a temperature of X'° C. at which a value of the ratio of the storage modulus after heat left G' at a temperature of X° C. after being left to stand at the temperature of X° C. for 2 hours to the storage modulus before heat left G' at the temperature of X° C. before being left to stand at the temperature of X° C. becomes the maximum is set to be within the range of $1.0\times10^8$ to $5.0\times10^8$ Pa.

Figure 1:
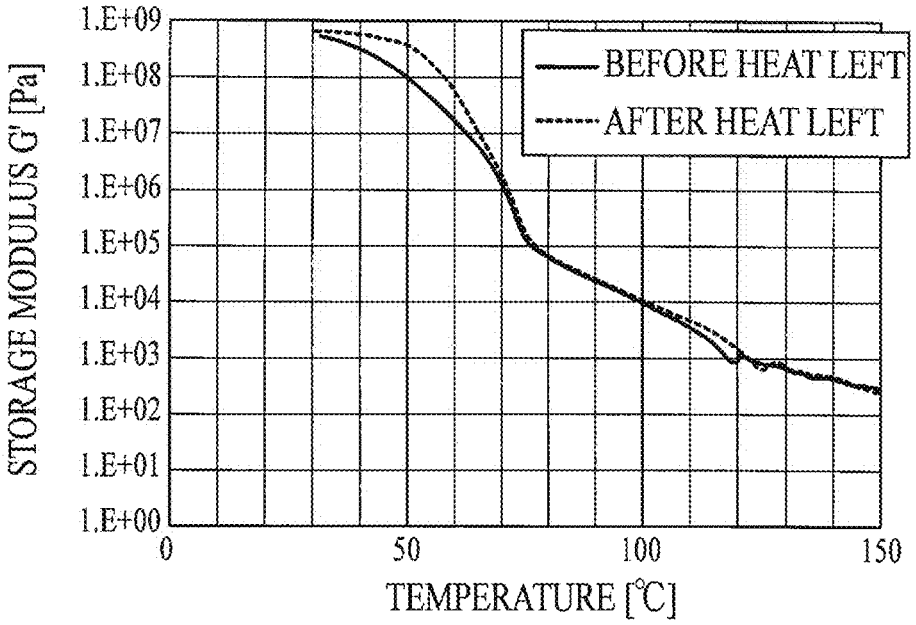
FIG. 1 is a graph showing the relationship between the temperature and the storage modulus G' before being heat-left to stand and after being heat-left to stand of the electrostatic charge image developing toner according to the embodiment of the present invention.

Further, in the present invention, in a case where the toner is heat-left to stand under a temperature condition lower than the softening temperature of the toner, as shown in FIG. 1, it was found that the storage modulus G' of the toner at a temperature within a specific range can be increased. This is considered because by adequately adjusting the polarity, ratio, and the like of the crystalline polyester resin and the amorphous polyester resin, the crystalline resin in a compatible state is crystallized and the plasticization effect of the binder resin is lost, and an increase in the glass transition point Tg of the amorphous polyester resin has occurred.

In addition, it is considered that the reason why the generation of gloss memory is suppressed by the present invention is because the styrene-acrylic resin contained in the binder resin suppresses the compatibility of the release agent with the amorphous polyester resin, and as a result the release agent is finely dispersed more uniformly.

Note that the styrene-acrylic resin is a resin having a high melting point, which is conventionally added for the purpose of improving the heat-resistant storability, therefore, when the ratio to the whole amount of the binder resin is increased, the low temperature fixability of the toner may be lowered. Nevertheless, the reason why the present invention can maintain the conventional low temperature fixability and heat-resistant storability is considered because as described above, the ratio and the like of the crystalline polyester resin is adjusted depending on the content of the styrene-acrylic resin.

The electrostatic charge image developing toner of the present invention is characterized in that at least an amorphous polyester resin, a crystalline polyester resin, and a styrene-acrylic resin are contained as a binder resin, and further a release agent is contained, the ratio of the crystalline polyester resin to the total amount of the amorphous polyester resin and the crystalline polyester resin is within the range exceeding 40% by mass to 60% by mass, the temperature at which a storage modulus before heat left G' before being left to stand at a temperature of X° C. becomes $1.0\times10^8$ Pa is within the range exceeding 45° C. to 55° C., and the storage modulus after heat left G' at a temperature of X'° C. at which a value of the ratio of the storage modulus after heat left G' at a temperature of X° C. after being left to stand at the temperature of X° C. for 2 hours to the storage modulus before heat left G' at the temperature of X° C. becomes the maximum is within the range of $1.0\times10^8$ to $5.0\times10^8$ Pa.

This characteristic is a technical feature common to the invention according to each of the following embodiments. In this way, an electrostatic charge image developing toner that is excellent in the low temperature fixability and the heat-resistant storability, and further can suppress the generation of gloss memory can be obtained.

In addition, as an embodiment of the present invention, it is preferred that the ratio of the crystalline polyester resin to the total amount of the amorphous polyester resin and the crystalline polyester resin is 42% by mass or more. In this way, the low temperature fixability and the heat-resistant storability both can be achieved more suitably.

Further, as an embodiment of the present invention, it is preferred that the ratio of the styrene-acrylic resin to the whole amount of the binder resin is larger than 25% by mass. In this way, the compatibility of the release agent can be further suppressed, and the release agent can be more uniformly dispersed.

In addition, as an embodiment of the present invention, it is preferred that the storage modulus after heat left G' is larger than the storage modulus before heat left G'. In this way, the heat-resistant storability can be further improved.

Moreover, as an embodiment of the present invention, it is preferred that the crystalline polyester resin is a hybrid crystalline polyester resin formed by bonding a crystalline polyester polymerization segment and a polymerization segment of another resin. In this way, the compatibility or incompatibility of a binder resin and a release agent, and the crystallization can be suitably adjusted.

Further, as an embodiment of the present invention, it is preferred that the ratio of the polymerization segment of another resin to the whole amount of the hybrid crystalline polyester resin is within the range of 1 to 10% by mass. In this way, the low temperature fixability and the heat-resistant storability both can be achieved more suitably.

In addition, as an embodiment of the present invention, it is preferred that the melting point Tm of a crystalline resin containing the crystalline polyester resin and the release agent is within the range of 60 to 75° C. In this way, the low temperature fixability of the toner can be further improved.

Moreover, as an embodiment of the present invention, it is preferred that the volume median diameter of the crystalline polyester resin is within the range of 40 to 150 nm. In this way, the crystal of the crystalline polyester resin becomes microcrystalline, therefore, the crystallization easily proceeds when the crystalline polyester resin is heat-left to stand. As a result, the storage modulus after heat left G' increases as shown in FIG. 1.

Hereinafter, the present invention and the constituent elements, and the embodiments and modes for carrying out the present invention will be described in detail. Note that in the present application, the expression "to" is used with the meaning of including the numerical values described before and after the "to" as the lower limit value and the upper limit value, respectively.

<Overview of Electrostatic Charge Image Developing Toner>

In the electrostatic charge image developing toner of the present embodiment (hereinafter, also referred to as "toner"), at least an amorphous polyester resin, a crystalline polyester resin, and a styrene-acrylic resin are contained as a binder resin, and further a release agent is contained, and the ratio of the crystalline polyester resin to the total amount of the amorphous polyester resin and the crystalline polyester resin is within the range exceeding 40% by mass to 60% by mass.

Moreover, in the toner of the present embodiment, the temperature at which a storage modulus before heat left G' before being left to stand at a temperature of X° C. becomes $1.0\times10^8$ Pa is within the range exceeding 45° C. to 55° C., and the storage modulus after heat left G' at a temperature of X'° C. at which a value of the ratio of the storage modulus after heat left G' at a temperature of X° C. after being left to stand at the temperature of X° C. for 2 hours to the storage modulus before heat left G' at the temperature of X° C. becomes the maximum is within the range of $1.0\times10^8$ to $5.0\times10^8$ Pa.

In the present invention, the expression "toner" is referred to as an aggregate of "toner particles".

Further, the expression "toner particles" is referred to as the one obtained by adding an external additive to the toner base particles containing a binder resin. Note that in the following description, in a case where it is not necessary to distinguish toner base particles from toner particles, these may be simply referred to as "toner particles".

The "toner base particles" contain a release agent as an internal additive in addition to the binder resin. Further, if necessary, in addition to the release agent, various internal additives such as a coloring agent, a charge control agent, and a surfactant may be contained.

In addition, the "X" and "X'" in the present invention are arbitrary values within the range not exceeding the melting point of the crystalline polyester resin.

Further, in the present invention, the "storage modulus before heat left G" of the toner is obtained by performing the following (1) to (4).

(1) A predetermined amount of toner is weighed under a predetermined environment (temperature, and humidity), placed in a cylinder, a predetermined pressure is applied by a compression molding machine to perform pressure molding, and a cylindrical pellet to be used as a measurement sample is prepared.

(2) The temperature of a measurement part of a rheometer is set to a predetermined temperature (for example, 100° C.), and the prepared pellet is sandwiched between a pair of upper and lower parallel plates of the measurement part.

(3) The parallel plate gap is set to a predetermined value.

(4) The temperature of the measurement part is lowered to a predetermined measurement starting temperature (for example, 30° C.).

(5) While applying a sinusoidal oscillation of a predetermined frequency to the pellet from the lower parallel plate, the temperature of the measurement part is raised from the predetermined measurement starting temperature at a predetermined temperature rise rate, changes in the storage modulus before heat left G' are measured, and the obtained measurement results are plotted in a graph as shown in FIG. 1.

In addition, in the present invention, the "storage modulus after heat left G" of the toner is obtained by performing the following (6) to (11).

(6) A predetermined amount of toner is weighed under a predetermined environment (temperature, and humidity), placed in a cylinder, a predetermined pressure is applied by a compression molding machine to perform pressure molding, and a cylindrical pellet to be used as a measurement sample is prepared.

(7) The temperature of a measurement part is set to a predetermined temperature (for example, 100° C.), and the prepared pellet is sandwiched between a pair of upper and lower parallel plates of a rheometer.

(8) The parallel plate gap is set to a predetermined value.

(9) The pellet sandwiched between the parallel plates is cooled down to a predetermined leaving temperature (for example, 40° C.) while applying a predetermined axial force, and are left to stand for a predetermined time (for example, 2 hours).

(10) The temperature of the measurement part is lowered to a predetermined measurement temperature (for example, 30° C.).

(11) While applying a sinusoidal oscillation of a predetermined frequency to the pellet from the lower parallel plate, the temperature of the measurement part is raised from a predetermined measurement starting temperature at a predetermined temperature rise rate, changes in the storage modulus after heat left G' are measured, and the obtained measurement results are plotted in a graph as shown in FIG. 1.

As described above, in the present invention, the storage modulus measured from the toner that has not been left to stand for a predetermined time at a predetermined leaving temperature is defined as the storage modulus before heat left G', and the storage modulus measured from the toner that has been left to stand for a predetermined time is defined as the storage modulus after heat left G'. That is, in the present invention, the expression "before heat left" and the expression "before being left to stand" refer to a state in which the toner obtained by drying after the production has not been left in an environment exceeding a predetermined leaving temperature for a predetermined time (2 hours) or longer.

In addition, in the present invention, the "the storage modulus after heat left G' at a temperature of X'° C. at which a value of the ratio of the storage modulus after heat left G' at a temperature of X° C. after being left to stand at the temperature of X° C. for 2 hours to the storage modulus before heat left G' at the temperature of X° C. before being left to stand at the temperature of X° C. becomes the maximum" is determined as follows.

(1) In the similar manner as in the above (6) to (11) except that the leaving temperature is changed in predetermined increments, the relationship between the temperature and the storage modulus after heat left G' is sequentially plotted in a graph.

(2) From the obtained graph of storage modulus before heat left G' and graphs of storage modulus after heat left G', the storage modulus before heat left G' and storage modulus after heat left G' at a leaving temperature when the graph was obtained are determined, respectively, and a value of the ratio [storage modulus after heat left G'/storage modulus before heat left G'] is calculated.

(3) The obtained multiple calculation results are plotted on a graph with the leaving temperature on the X axis and the value of the ratio on the Y axis, a leaving temperature X'° C. at which a value of the ratio [storage modulus after heat left G'/storage modulus before heat left G'] becomes the maximum is calculated from the plots, and the storage modulus after heat left G' at that time is specified.

When the temperature at which the storage modulus before heat left G' becomes $1.0\times10^8$ Pa is 45° C. or less, the heat-resistant storability may be deteriorated in some cases. On the other hand, when the temperature exceeds 55° C., the low temperature fixability may be deteriorated in some cases.

However, in the toner of the present invention, the temperature at which the storage modulus before heat left G' becomes $1.0\times10^8$ Pa is set to be within the range exceeding 45° C. to 55° C., therefore, the low temperature fixability and the heat-resistant storability both can be achieved.

In addition, when the storage modulus after heat left G' at a temperature of X'° C. at which a value of the ratio of the storage modulus after heat left G' at a temperature of X° C. after being left to stand at the temperature of X° C. for 2 hours to the storage modulus before heat left G' at the temperature of X° C. before being left to stand at the temperature of X° C. (storage modulus after heat left G'/storage modulus before heat left G') becomes the maximum exceeds $5.0\times10^8$ Pa, the low temperature fixability may be deteriorated in some cases.

However, in the toner of the present invention, the storage modulus after heat left G' is set to be within a range of $1.0\times10^8$ to $5.0\times10^8$ Pa, therefore, the sufficient heat-resistant storability can be obtained.

Hereinafter, each component constituting the toner will be described in detail.

[Binder Resin]

The toner of the present invention is characterized by containing as a binder resin, at least a crystalline polyester resin, an amorphous polyester resin, and a styrene-acrylic resin.

The expression "crystalline polyester resin" in the present invention refers to a resin that shows a clear endothermic peak indicating that endothermic change (crystallization) has been generated, in the DSC curve obtained when differential scanning calorimetry (DSC) is performed. Note that the clear endothermic peak herein refers to a peak at which the half value width of the endothermic peak on the DSC curve obtained when measured at a heating rate of 10° C./min is within 15° C.

On the other hand, the expression "amorphous polyester resin" of the present invention refers to a resin that show a baseline curve indicating that glass transition has been generated, but does not show the clear endothermic peak described above, in the DSC curve obtained when differential scanning calorimetry is performed as in the above.

In addition, in the present embodiment, as long as the effects of the present invention are not inhibited, as a crystalline resin, for example, a known resin such as a polyolefin-based resin, and a polydiene-based resin can be used.

[Crystalline Polyester Resin]

The crystalline polyester resin is, for example, a polyester resin showing crystallinity among the polyester resins obtained by a dehydration condensation reaction between a polyvalent carboxylic acid and a polyhydric alcohol. In addition, the crystalline polyester resin to be contained may be one kind or multiple kinds.

The monomer constituting the crystalline polyester resin contains a linear aliphatic monomer preferably in an amount of 50% by mass or more, and more preferably in an amount of 80% by mass or more. In a case where an aromatic monomer is used, the crystalline polyester resin has a high melting point in many cases, and in a case where a branched aliphatic monomer is used, the melting point becomes low in many cases, therefore, it is preferred that a linear aliphatic monomer is used. Further, when the linear aliphatic monomer is 50% by mass or more, the crystallinity can be maintained in the toner. When the content is 80% by mass or more, the sufficient crystallinity can be maintained.

Similarly as in the above-described amorphous polyester resin, examples of the polyvalent carboxylic acid include a saturated aliphatic dicarboxylic acid such as succinic acid, sebacic acid, and dodecanedioic acid; an alicyclic dicarboxylic acid such as cyclohexane dicarboxylic acid; an aromatic dicarboxylic acid such as phthalic acid, isophthalic acid, and terephthalic acid; a polyvalent carboxylic acid having a valence of 3 or more such as trimellitic acid, and pyromellitic acid; and an acid anhydride thereof or an alkyl ester having 1 to 3 carbon atoms thereof. Among them, an aliphatic dicarboxylic acid is preferred.

Examples of the polyhydric alcohol include an aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and a trivalent or higher alcohol such as glycerin, pentaerythritol, trimethylol propane, and sorbitol. Among them, an aliphatic diol is preferred.

The volume median diameter of the crystalline polyester resin is preferably within the range of 40 to 150 nm, and more preferably within the range of 50 to 120 nm. In this way, the crystal of the crystalline polyester resin becomes microcrystalline, therefore, the crystallization easily proceeds when the crystalline polyester resin is heat-left to stand.

Further, the number average molecular weight Mn of the crystalline polyester resin is, from the viewpoint of the low temperature fixability, preferably within the range of 2000 to 12500, and more preferably within the range of 5000 to 11000.

Note that in the present invention, the number average molecular weight Mn is determined from the molecular weight distribution measured by gel permeation chromatography (GPC).

Specifically, to a column stabilized at 40° C., tetrahydrofuran (THF) is flowed as a solvent at a flow rate of 0.2 mL/min, and around 10 μL of a THF sample solution of a resin, which has been adjusted to have a concentration of 1 mg/mL, is injected, and the measurement is performed.

In the molecular weight measurement of a sample, the detection is performed by using a refractive index detector (RI detector), and the molecular weight distribution of the sample is calculated using a calibration curve prepared from a monodisperse polystyrene standard sample. As the polystyrene standard sample for the calibration curve measurement, by using samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are manufactured by Pressure Chemical Company, ten standard polystyrene samples are measured to prepare the calibration curve.

In addition, the melting point Tm of the crystalline polyester resin is preferably within the range of 60 to 75° C. When the melting point Tm is 75° C. or less, the low temperature fixability is improved, and when the melting point Tm is 60° C. or more, the heat-resistant storability is improved.

Note that in the present invention, the melting point Tm is DSC-measured by a differential scanning calorimetry analysis using a differential scanning calorimeter "DSC-7" (manufactured by PerkinElmer, Inc.) and a thermal analyzer controller "TAC7/DX" (manufactured by PerkinElmer, Inc.).

Specifically, 0.5 mg of a measurement sample is sealed in a pan made of aluminum (KITNO. 0219-0041), the pan is set in a sample holder of "DSC-7", the temperature control of Heat-cool-Heat is performed under measurement conditions of a measurement temperature within the range of 0 to 200° C., a temperature rise rate of 10° C./min, and a temperature drop rate of 10° C./min, and analysis is performed based on the data in the 1st. Heat. Provided that an empty pan made of aluminum is used for the measurement of the reference. The peak top temperature of the endothermic peak derived from the crystalline resin in 1st. Heat is taken as Tm. In a case where there are multiple endothermic peaks derived from the crystalline resin, the peak top temperature of the peak on the lowest temperature side is taken as Tm.

Note that in the present invention, data in 2nd. Heat of the DSC measurement are obtained, and the intersection point of an extension line of the baseline before the rise of the first endothermic peak, and a tangent line showing the maximum inclination between the rising part and peak apex of the first endothermic peak is taken as the glass transition point Tg.

The ratio of such a crystalline polyester resin to the total amount of the amorphous polyester resin and the crystalline polyester resin is within the range exceeding 40% by mass to 60% by mass as described above in the present invention, and is preferably within the range of 42% by mass to 55% by mass.

When the ratio of the crystalline polyester resin is extremely low (40% by mass or less), the temperature at which the storage modulus G' becomes $1.0\times10^8$ Pa is high, and the low temperature fixability may be deteriorated in some cases. On the other hand, when the ratio of the crystalline polyester resin is extremely high (exceeding 60% by mass), the crystalline polyester resin that is present in a compatible state even after being heat-left to stand is excessively increased, therefore, the heat-resistant storability may be deteriorated in some cases. However, by setting the ratio as in the present embodiment, the amount of the crystalline polyester being present in an incompatible state in the toner after being heat-left to stand becomes an appropriate amount, as a result of which both of the low temperature fixability and the heat-resistant storability of the toner can be achieved.

[Hybrid Crystalline Polyester Resin]

In addition, in the present invention, it is preferred that as the crystalline polyester resin, a hybrid crystalline polyester resin formed by chemically bonding at least a crystalline polyester polymerization segment and a polymerization segment having another type structure different from that of the crystalline polyester polymerization segment is used. That is, a hybrid crystalline polyester resin modified with a resin having another type structure is preferred.

Herein, the expression "resin having another type structure" refers to a resin made of a different kind of resin and having a different chemical structure, but a resin that differs only in the monomer composition ratio or the presence or absence of modification is not included.

Hereinafter, in the hybrid crystalline polyester resin, a resin part having a structure derived from a crystalline polyester resin is referred to as a "crystalline polyester polymerization segment", and a resin part having a structure derived from a resin having another type structure is referred to as a "polymerization segment of another resin".

Further, examples of the resin having another type structure include a vinyl resin such as a styrene-acrylic resin, a urethane resin, and a urea resin. Among them, a styrene-acrylic resin is preferably used. The styrene-acrylic resin to be used herein may be the same as the styrene-acrylic resin contained in a binder resin described later, and the details will be described later. In addition, as the polymerization segment of another resin, these may be used singly alone, or in combination of two or more kinds thereof.

Further, the ratio of the polymerization segment of another resin in the hybrid crystalline polyester resin is preferably within the range of 1 to 10% by mass from the viewpoint of the low temperature fixability.

Note that even in a case where a crystalline polyester resin is used as the hybrid crystalline polyester resin, the preferred ranges of the proportion to the total amount of the amorphous polyester resin and the crystalline polyester resin, the number average molecular weight Mn, the melting point Tm, and the volume median diameter in the crystalline polyester resin are similar to those of the above-described crystalline polyester resin.

A hybrid crystalline polyester resin having a polymerization segment of a styrene-acrylic resin as the polymerization segment of another resin (that is, a hybrid crystalline polyester resin modified with a styrene-acrylic resin) can be obtained as follows.

Firstly, a production method in which a crystalline polyester resin and a styrene-acrylic resin are separately prepared, and then the crystalline polyester resin is reacted with the styrene-acrylic resin for the chemical bonding to obtain a hybrid crystalline polyester resin can be mentioned. From the viewpoint of facilitating the bonding, it is preferred that a substituent capable of reacting with both of a crystalline polyester resin and a styrene-acrylic resin is incorporated into the crystalline polyester resin or the styrene-acrylic resin. For example, during the generation of the styrene-acrylic resin, together with a styrene-based monomer and a (meth)acrylic monomer, which are raw materials, a compound having a substituent capable of reacting with a carboxyl group [COOH] or a hydroxy group [OH] that is possessed by the crystalline polyester resin, and a substituent capable of reacting with the styrene-acrylic resin is added. In this way, a styrene-acrylic resin having a substituent capable of reacting with a carboxyl group or hydroxy group in a crystalline polyester resin can be obtained.

In addition, as another example of the method for producing a hybrid crystalline resin, a method in which a polymerization reaction to generate a styrene-acrylic resin in the presence of a crystalline polyester resin that has been prepared in advance is performed, or a polymerization reaction to generate a crystalline polyester resin in the presence of a styrene-acrylic resin that has been prepared in advance is performed to obtain a hybrid crystalline polyester resin can be mentioned. In any one of the cases, during the polymerization reaction, a compound having a substituent capable of reacting with both of the crystalline polyester resin and styrene-acrylic resin as described above is added. Further, specific examples of such a compound include acrylic acid, methacrylic acid, fumaric acid, maleic acid, and maleic anhydride.

As described above, by using the hybrid crystalline polyester resin as the crystalline polyester resin, the compatibility or incompatibility of the binder resin and release agent contained in toner base particles, and the crystallization, can be suitably adjusted, and as a result, the effect of the invention of the present application can be more suitably exerted.

In particular, if a styrene-acrylic resin is used as a resin having another type structure, the compatibility with the amorphous resin in the styrene-acrylic resin part is enhanced, therefore, the crystalline polyester resin can be uniformly dispersed in the toner base particles.

In addition, in a case where the toner base particles have a core-shell structure described later, and the shell contains a hybrid crystalline resin, the styrene-acrylic resin part is easily aggregated on a surface of the core particle containing an amorphous resin, and the entire surface of the core particle is easily coated.

[Amorphous Polyester Resin]

An amorphous polyester resin is a polyester resin showing amorphousness among the polyester resins obtained by a dehydration condensation reaction of divalent or higher carboxylic acid (polyvalent carboxylic acid) with divalent or higher alcohol (polyhydric alcohol). In a case of forming a toner having a core-shell structure described later, an amorphous polyester resin can also be used as a material of the shell. In addition, the crystalline polyester resin to be contained may be one kind or multiple kinds.

Examples of the polyvalent carboxylic acid include a saturated aliphatic dicarboxylic acid such as succinic acid, sebacic acid, and dodecanedioic acid; an alicyclic dicarboxylic acid such as cyclohexane dicarboxylic acid; an aromatic dicarboxylic acid such as phthalic acid, isophthalic acid, and terephthalic acid; a polyvalent carboxylic acid having a valence of 3 or more such as trimellitic acid, and pyromellitic acid; and an acid anhydride thereof or an alkyl ester having 1 to 3 carbon atoms thereof. Among them, an aliphatic dicarboxylic acid is preferred. In addition, these polyvalent carboxylic acid components may be used singly alone, or in combination of two or more kinds thereof.

As the polyhydric alcohol, in addition to an aliphatic diol such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and a trivalent or higher alcohol such as glycerin, pentaerythritol, trimethylol propane, and sorbitol, for example, bisphenols such as bisphenol A and bisphenol F; and an alkylene oxide adduct of bisphenols such as an ethylene oxide adduct or propylene oxide adduct thereof can be mentioned. Among them, in particular, from the viewpoint of improving the charge uniformity of the toner, it is preferred to use an ethylene oxide adduct of bisphenol A and a propylene oxide adduct of bisphenol A as the polyhydric alcohol component. In addition, these polyhydric alcohol components may be used singly alone, or in combination of two or more kinds thereof.

The volume median diameter of the amorphous polyester resin is within the range of 40 to 150 nm, and more preferably within the range of 50 to 120 nm.

Further, the weight average molecular weight Mw of the amorphous polyester resin is preferably within the range of 1500 to 60000.

Furthermore, the glass transition point Tg of the amorphous polyester resin is preferably within the range of 20 to 70° C.

Moreover, the acid value of the amorphous polyester resin is preferably within the range of 15 to 30 mg KOH/g.

In addition, as is the case with the above-described crystalline polyester resin, the amorphous polyester resin is preferably a hybrid amorphous polyester resin that has a styrene-acrylic resin as a polymerization segment having another type structure from the viewpoint of making the core particle and the shell adequately easily settled to each other.

[Styrene-Acrylic Resin]

The styrene-acrylic resin to be contained as a binder resin in the toner of the present invention is preferably used as a resin having another type structure in the above-described hybrid crystalline polyester resin or hybrid amorphous polyester resin. Note that the expression "styrene-acrylic resin" is referred to as a polymer of a styrene-based monomer and a (meth)acrylic monomer.

Examples of the above-described styrene-based monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and a derivative thereof. In addition, those described above can be used singly alone, or in combination of two or more kinds thereof.

Examples of the above-described (meth)acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl 6-hydroxyacrylate, propyl γ-aminoacrylate, stearyl methacrylate, dimethylaminoethyl methacrylate, diethylaminoethyl methacrylate, 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate. In addition, those described above can be used singly alone, or in combination of two or more kinds thereof.

In the present embodiment, in addition to the above-described styrene-based monomers and (meth)acrylic monomers, other monomers can also be used. Examples of the other monomers that can be used include maleic acid, itaconic acid, cinnamic acid, fumaric acid, maleic acid monoalkyl ester, and itaconic acid monoalkyl ester.

The styrene-acrylic resin can be obtained by adding an arbitrary commonly-used polymerization initiator such as a peroxide, a persulfide, and an azo compound in polymerization of the above-described monomers, and by performing the polymerization by a known polymerization technique such as bulk polymerization, solution polymerization, an emulsion polymerization method, a mini-emulsion method, a suspension polymerization method, and a dispersion polymerization method. During the polymerization, for the purpose of adjusting the molecular weight, a commonly-used chain transfer agent such as an alkyl mercaptan, and a mercapto fatty acid ester can be used.

In the present embodiment, it is preferred that the ratio of the styrene-acrylic resin to the whole amount of the binder resin is larger than 25% by mass. In this way, the compatibility of the release agent can be further suppressed, and the release agent can be more uniformly dispersed.

[Coloring Agent]

As the coloring agent that can be used for the toner of the present invention, a known inorganic or organic coloring agent that is used for the coloring agent of color toner can be mentioned. Examples of the coloring agent include carbon black, magnetic material, pigment, and dye. The above-described coloring agents may be used singly or in combination.

Examples of the carbon black include a channel black, a furnace black, an acetylene black, a thermal black, and a lamp black. Examples of the magnetic material include a ferromagnetic metal such as iron, nickel, and cobalt; an alloy containing these metals; and a compound of a ferromagnetic metal such as ferrite, and magnetite.

Examples of the pigment include C.I. Pigment Red 2, C.I. Pigment Red 3, C.I. Pigment Red 5, C.I. Pigment Red 7, C.I. Pigment Red 15, C.I. Pigment Red 16, C.I. Pigment Red 48:1, C.I. Pigment Red 48:3, C.I. Pigment Red 53:1, C.I. Pigment Red 57:1, C.I. Pigment Red 81:4, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 208, C.I. Pigment Red 209, C.I. Pigment Red 222, C.I. Pigment Red 238, C.I. Pigment Red 269, C.I. Pigment Orange 31, C.I. Pigment Orange 43, C.I. Pigment Yellow 3, C.I. Pigment Yellow 9, C.I. Pigment Yellow 14, C.I. Pigment Yellow 17, C.I. Pigment Yellow 35, C.I. Pigment Yellow 36, C.I. Pigment Yellow 65, C.I. Pigment Yellow 74, C.I. Pigment Yellow 83, C.I. Pigment Yellow 93, C.I. Pigment Yellow 94, C.I. Pigment Yellow 98, C.I. Pigment Yellow 110, C.I. Pigment Yellow 111, C.I. Pigment Yellow 138, C.I. Pigment Yellow 139, C.I. Pigment Yellow 153, C.I. Pigment Yellow 155, C.I. Pigment Yellow 180, C.I. Pigment Yellow 181, C.I. Pigment Yellow 185, C.I. Pigment Green 7, C.I. Pigment Blue 15:3, C.I. Pigment Blue 15:4, C.I. Pigment Blue 60, and a phthalocyanine pigment of which the center metal is zinc, titanium, magnesium or the like.

Examples of the dye include C.I. Solvent Red 1, C.I. Solvent Red 3, C.I. Solvent Red 14, C.I. Solvent Red 17, C.I. Solvent Red 18, C.I. Solvent Red 22, C.I. Solvent Red 23, C.I. Solvent Red 49, C.I. Solvent Red 51, C.I. Solvent Red 52, C.I. Solvent Red 58, C.I. Solvent Red 63, C.I. Solvent Red 87, C.I. Solvent Red 111, C.I. Solvent Red 122, C.I. Solvent Red 127, C.I. Solvent Red 128, C.I. Solvent Red 131, C.I. Solvent Red 145, C.I. Solvent Red 146, C.I. Solvent Red 149, C.I. Solvent Red 150, C.I. Solvent Red 151, C.I. Solvent Red 152, C.I. Solvent Red 153, C.I. Solvent Red 154, C.I. Solvent Red 155, C.I. Solvent Red 156, C.I. Solvent Red 157, C.I. Solvent Red 158, C.I. Solvent Red 176, C.I. Solvent Red 179, pyrazolotriazole azo dye, pyrazolotriazole azomethine dye, pyrazolone azo dye, pyrazolone azomethine dye, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95.

[Release Agent]

Examples of the release agent (wax) include a hydrocarbon-based wax, and an ester wax. Examples of the hydrocarbon-based wax include low molecular weight polyethylene wax, low molecular weight polypropylene wax, Fischer-Tropsch wax, microcrystalline wax, and paraffin wax. Further, examples of the ester wax include carnauba wax, pentaerythritol behenic acid ester, behenyl behenate, and behenyl citrate. In addition, the above-described release agents may be used singly or in combination.

Further, as is the case with the crystalline polyester resin and the hybrid crystalline polyester resin, the melting point of the release agent is preferably within the range of 60 to 75° C.

[Charge Control Agent]

Examples of the charge control agent include nigrosine-based dye, a metal salt of naphthenic acid or higher fatty acid, alkoxylated amine, a quaternary ammonium salt compound, an azo-based metal complex, and a salicylic acid metal salt or a metal complex thereof. In addition, the above-described charge control agents may be used singly or in combination.

[Surfactant]

Examples of the surfactant include an anionic surfactant such as a sulfuric ester salt-based, a sulfonate-based, and a phosphoric acid ester-based; a cationic surfactant such as an amine salt type, and a quaternary ammonium salt type; and a nonionic surfactant such as a polyethylene glycol-based, an alkyl phenol ethylene oxide adduct-based, and a polyhydric alcohol-based. In addition, the above-described surfactants may be used singly or in combination.

Examples of the anionic surfactant include sodium dodecylbenzene sulfonate, sodium dodecyl sulfate, sodium alkyl naphthalene sulfonate, and sodium dialkyl sulfosuccinate. Examples of the cationic surfactant include alkyl benzene dimethyl ammonium chloride, alkyl trimethyl ammonium chloride, and distearyl ammonium chloride. Examples of the nonionic surfactant include polyoxyethylene alkyl ether, glycerine fatty acid ester, sorbitan fatty acid ester, polyoxyethylene sorbitan fatty acid ester, and polyoxyethylene fatty acid ester.

[External Additive]

As the external additive, a known external additive can be used without particular limitation, and for example, silica particles, titania particles, alumina particles, zirconia particles, zinc oxide particles, chromium oxide particles, cerium oxide particles, antimony oxide particles, tungsten oxide particles, tin oxide particles, tellurium oxide particles, manganese oxide particles, or boron oxide particles can be used. In addition, the above-described external additives may be used singly or in combination.

It is more preferred that the external additive contains silica particles obtained by a sol-gel method. The silica particles obtained by a sol-gel method have a feature that the particle size distribution is narrow, therefore, are preferred from the viewpoint of suppressing the variation of the adhesion strength of the external additive to the toner base particles.

Further, the number average diameter of primary particles of the silica particles is preferably within the range of 70 to 200 nm. The silica particles having a number average diameter of primary particles within the above-described range are larger than other external additives in size. Therefore, the silica particles have a role as a spacer in a two-component developer. Accordingly, the silica particles are preferred from the viewpoint of preventing other smaller external additives from being embedded into the toner base particles when the two-component developer is stirred in a developing device. Moreover, the silica particles are preferred also from the viewpoint of preventing the fusion among the toner base particles.

The number average diameter of primary particles of the external additive can be determined, for example, by image processing of an image taken with a transmission electron microscope, and can be adjusted, for example, by classification or mixing of classified products.

It is preferred that the surface of the external additive is hydrophobized. For the hydrophobic treatment, a known surface treatment agent is used. The surface treatment agent may be used singly or in combination, and examples of the surface treatment agent include a silane coupling agent, a silicone oil, a titanate-based coupling agent, an aluminate-based coupling agent, fatty acid, a fatty acid metal salt, an esterification product thereof, and rosin acid.

Examples of the silane coupling agent include dimethyldimethoxysilane, hexamethyldisilazane (HMDS), methyltrimethoxysilane, isobutyltrimethoxysilane, and decyltrimethoxysilane.

As the silicone oil, a cyclic compound, a linear or branched organosiloxane, and the like are included, and specific examples of the silicone oil include an organosiloxane oligomer, octamethylcyclotetrasiloxane, decamethylcyclopentasiloxane, tetramethylcyclotetrasiloxane, and tetravinyltetramethylcyclotetrasiloxane.

Further, as the silicone oil, a silicone oil that is highly reactive and has at least a modified end, in which a modifying group is introduced into a side chain, one end or both ends, one side chain end, both side chain ends, or the like can be mentioned. The kind of the modifying group may be one kind or more. Examples of the kind of the modifying group include alkoxy, carboxy, carbinol, higher fatty acid-modified, phenol, epoxy, methacryl, and amino.

The addition amount of the external additive is preferably within the range of 0.1 to 10.0% by mass, and more preferably within the range of 1.0 to 3.0% by mass based on the whole toner particles.

[Developer]

As to the developer, in a case of a one-component developer, the developer is constituted of the above-described toner particles themselves, and in a case of a two-component developer, the developer is constituted of the above-described toner particles, and carrier particles. The content (toner concentration) of the toner particles in the two-component developer is similar to that of an ordinary two-component developer, and is, for example, within the range of 4.0 to 8.0% by mass.

The above-described carrier particles are constituted of a magnetic material. Examples of the carrier particles include coated-type carrier particles having core material particles made of the magnetic material and a coating material layer coating the surfaces of the core material particles, and resin dispersion type carrier particles in which fine powder of the magnetic material is dispersed in a resin. The carrier particles are, from the viewpoint of suppressing the adhesion of carrier particles to a photoreceptor, preferably the coated-type carrier particles.

The core material particles are constituted of a magnetic material, for example, a substance strongly magnetized in the direction by the magnetic field. The magnetic material may be used singly or in combination, and examples of the magnetic material include a metal exhibiting ferromagnetism such as iron, nickel, and cobalt; an alloy or compound containing these metals; an alloy exhibiting ferromagnetism by heat treatment; and metal oxide.

Examples of the metal exhibiting ferromagnetism or a compound containing thereof include iron, ferrite represented by the following formula (a), and magnetite represented by the following formula (b). M in the formula (a), and formula (b) represents one or more of monovalent or divalent metals selected from a group of Mn, Fe, Ni, Co, Cu, Mg, Zn, Cd, and Li.

$MO.Fe_2O_3$ Formula (a):

$MFe_2O_4$ Formula (b):

Further, examples of the alloy exhibiting ferromagnetism by heat treatment or metal oxide include a Heusler alloy of manganese-copper-aluminum, manganese-copper-tin, or the like, and chromium oxide.

The core material particles are preferably the above-described ferrite. This is because the specific gravity of the coated-type carrier particles is smaller than the specific gravity of the metal constituting the core material particles, therefore, the impact force of stirring in a developing device can be further reduced.

The above-described coating material may be used singly or in combination. As the coating material, a known resin used for coating the core material particles of the carrier particles can be used. It is preferred that the coating material is a resin having a cycloalkyl group from the viewpoint of reducing the moisture adsorption of the carrier particles and from the viewpoint of enhancing the adhesion of the coating layer to the core material particles. Examples of the cycloalkyl group include a cyclohexyl group, a cyclopentyl group, a cyclopropyl group, a cyclobutyl group, a cycloheptyl group, a cyclooctyl group, a cyclononyl group, and a cyclodecyl group. Among them, a cyclohexyl group, or a cyclopentyl group is preferred, and a cyclohexyl group is more preferred from the viewpoint of the adhesion of a coating layer to ferrite particles.

The weight average molecular weight of a resin having the cycloalkyl group is, for example, within the range of 10000 to 800000, and more preferably within the range of 100000 to 750000. The content of the cycloalkyl group in the resin is, for example, within the range of 10 to 90% by mass. The content of the cycloalkyl group in the resin can be determined, for example, by using a known instrumental analysis method such as P-GC/MS, or $^1$H-NMR.

The two-component developer can be produced by mixing appropriate amounts of the toner particles and the carrier particles. Examples of the mixing device used for the mixing include a Nauta mixer, a W-cone, and a V-type mixer.

The size and shape of the toner particles can be appropriately determined within the range where the effect of the present embodiment can be obtained. For example, the volume median diameter of the toner particles is within the range of 3.0 to 8.0 μm, and the average circularity of the toner particles is within the range of 0.920 to 1.000.

In addition, the size and shape of the carrier particles can also be appropriately determined within the range where the effect of the present embodiment can be obtained. For example, the volume median diameter of the carrier particles is within the range of 15 to 100 μm. The volume median diameter of the carrier particles can be measured by a wet process using, for example, a laser diffraction particle size analyzer "HELOS KA" (manufactured by Sympatec GmbH). Further, the volume median diameter of the carrier particles can be adjusted, for example, by a method of controlling the particle diameter of the core material particles according to the production conditions of the core material particles, classification of carrier particles, mixing of classified carrier particles, or the like.

[Structure of Toner Particles]

Each of the toner particles according to the present invention, which is constituted of the above-described components, may have a single layer structure only with the toner particle, however, is preferred to have a core-shell structure. In this way, the low temperature fixability and the heat-resistant storability can be made more favorable.

The toner particle having a core-shell structure is referred to as a toner particle having a multilayer structure including a core particle and a shell coating a surface of the core particle. The shell may not coat the entire surface of the core particle, and the core particle may be partially exposed. The cross section of the core-shell structure can be confirmed, for example, by a known observation means such as a transmission electron microscope (TEM), and a scanning probe microscope (SPM).

In a case of the core-shell structure, the characteristics of the glass transition point Tg, the melting point Tm, and the hardness can be made different from each other in the core particle and shell, and the toner particle can be designed depending on the intended purpose. For example, a resin having a relatively high glass transition point can be aggregated, and be fused onto the surface of a core particle containing a binder resin, a coloring agent, and a release agent and having a relatively low glass transition point to form a shell. For the shell, an amorphous polyester resin can be used as described above.

The volume median diameter of the toner particles according to the present invention is preferably within the range of 3 to 8 μm, and more preferably within the range of 5 to 8 μm.

The volume median diameter can be measured using a measurement device connected to a computer system in which software for data processing "Software V 3.51" is mounted on "Multisizer 3" (manufactured by Beckman Coulter, Inc.). Specifically, 0.02 g of a sample (toner) is added to 20 mL of a surfactant solution (for example, a surfactant solution prepared by diluting a neutral detergent containing a surfactant component 10 times with pure water for the purpose of dispersing the toner particles) and allowed to be blended, and then the resultant mixture is subjected to ultrasonic dispersion for one minute to prepare a dispersion liquid of toner. This dispersion liquid of toner is injected with a pipette into a beaker containing "ISOTON II" (manufactured by Beckman Coulter, Inc.) in the sample stand until the display concentration of the measurement device reaches 8%. By setting the concentration in this concentration, a reproducible measurement value can be obtained.

Subsequently, in the measurement device, the measurement particle count number is set to 25000, the aperture diameter is set to 100 μm, the range of 2 to 60 μm, which is the measurement range, is divided into 256 to calculate the frequency value, and the particle diameter corresponding to 50% from the larger volume-integrated fraction is determined as the volume median diameter.

In addition, in the toner of the present invention, the average circularity of toner particles is preferably within the range of 0.930 to 1.000, and more preferably within the range of 0.950 to 0.995. When the average circularity is within the range described above, the crushing of the toner particles can be suppressed, the contamination of the triboelectric charging member is suppressed, and the toner chargeability can be stabilized. Further, the image formed of the toner has high image quality.

The average circularity can be measured as follows. A dispersion liquid of toner is prepared in the similar manner as in the case of measuring the median diameter. The dispersion liquid of toner is photographed with FPIA-2100, FPIA-3000 (both manufactured by Sysmex Corporation), or the like in an HPF (high power focusing) mode in an appropriate concentration range of the HPF detection number of 3000 to 10000, and the circularity of each of toner particles is calculated in accordance with the following equation (y). The values of circularity of the toner particles are summed, and the average circularity is calculated by dividing the sum of the values of circularity by the number of the toner particles. When the HPF detection number is in the above-described appropriate concentration range, sufficient reproducibility is obtained. In the following equation (y), L1 represents the circumference length (μm) of a circle having an area equivalent to the projection area of a particle image, and L2 represents the circumference length (□m) of a projection image of a particle.

$$\text{circularity}=L1/L2 \qquad \text{Equation (y):}$$

[Production Method of Toner]

The method for producing the toner according to the present invention is not particularly limited, and a known method can be adopted, and in particular, an emulsion polymerization aggregation method or an emulsion aggregation method can be suitably adopted.

An emulsion aggregation method preferably used as the method for producing the toner according to the present invention is a method in which a poor solvent is added dropwise into a binder resin solution obtained by dissolving a binder resin in a solvent to perform phase inversion emulsification, then the desolvation is performed to prepare a dispersion liquid of binder resin fine particles, this dispersion liquid of resin fine particles, a dispersion liquid of coloring agent fine particles, and a dispersion liquid of release agent fine particles of wax or the like are mixed and aggregated until the desired particle diameter of toner particle is obtained, further, fusion among the binder resin fine particles is conducted to control the shape, and the toner particles are prepared.

An example of a case where the emulsion aggregation method is used as a method for producing the toner of the present invention is described below.

(1) A step of preparing a dispersion liquid in which fine particles of a binder resin (amorphous polyester resin, crystalline polyester resin, and styrene-acrylic resin) containing an internal additive as needed are dispersed in an aqueous medium;

(2) A step of preparing a dispersion liquid in which fine particles of a coloring agent are dispersed in an aqueous medium;

(3) A step of forming toner base particles by mixing the dispersion liquid of fine particles of a coloring agent and the dispersion liquid of binder resin fine particles to aggregate, associate, and fuse the fine particles of a coloring agent and the binder resin fine particles;

(4) A step of removing a surfactant and the like by filtering the toner base particles from a dispersion system (aqueous medium) of the toner base particles;

(5) A step of drying the toner base particles; and (6) A step of adding an external additive to the toner base particles.

Hereinafter, an example of the step (3) will be specifically described.

Into a reaction vessel equipped with a stirring device, a temperature sensor, and a cooling pipe, a dispersion liquid of binder resin fine particles of a crystalline polyester resin, an amorphous polyester resin, an amorphous vinyl resin, and the like, and a dispersion liquid of coloring agent fine particles are charged, a solution of a coagulant (for example, magnesium chloride) is added under stirring, and the binder resin fine particles and the coloring agent fine particles are aggregated, associated, and fused to grow particles. An aqueous solution of sodium chloride is added at a desired timing to stop the growth of the particles.

Next, the resultant preparation is heated and stirred, the fusion among the particles is allowed to proceed until the average circularity of the toner particles reaches a desired value, and after the toner reaches a predetermined particle diameter and circularity, the resultant preparation is cooled at a predetermined temperature drop rate. The temperature drop rate is set to 0.5° C./min or more, and more preferably 1° C./min or more. After that, as a heat treatment step (annealing), for example, the temperature is raised up to 50° C. over 30 minutes while stirring, and the temperature is maintained for around 3 hours.

After that, the toner of the present invention can be produced through the steps (4) to (6).

As described above, in the toner according to the present invention, since the toner particles are cooled so as to relatively quickly pass through the vicinity of the melting point Tm of the crystalline polyester resin at the temperature drop rate as described above in the step (3), the crystalline polyester resin becomes microcrystalline in volume median diameter of 40 to 150 nm. In this way, the crystallization easily proceeds when the crystalline polyester resin is heat-left to stand.

Note that the steps other than the above step (3), that is, the steps (1), (2), and (4) to (6) are not particularly limited, and a known method can be suitably adopted. In addition, a known step other than the above steps (1) to (6) can be adopted as long as the effect of the invention of the present application is not impaired.

As described above, the embodiments in which the present invention can be applied have been described, however, the present invention is not limited to the embodiments described above, and appropriate changes may be made in the range where the gist of the present invention is not impaired.

EXAMPLES

Hereinafter, the present invention will be described specifically with reference to Examples, however, the present invention is not limited to the following Examples.

Synthesis and Preparation of Raw Material

Prior to the production of toner, an amorphous polyester resin (a), a dispersion liquid (A) of fine particles of the amorphous polyester resin, crystalline polyester resins (c1) to (c5), dispersion liquids (C1) to (C6) of fine particles of each of the crystalline polyester resins (c1) to (c5), a dispersion liquid of coloring agent fine particles, a dispersion liquid (W) of release agent fine particles, and a dispersion liquid (S1) of styrene-acrylic resin fine particles, which are raw materials for toner, were synthesized or prepared.

Synthesis Example of Amorphous Polyester Resin (a)

The following monomers of a vinyl resin, a bireactive monomer having a substituent that reacts with both of an amorphous polyester resin and a vinyl resin, and a polymerization initiator were mixed in the ratios shown below, and the mixture was placed in a dropping funnel.

| | |
|---|---|
| Styrene | 80.0 parts by mass |
| n-Butyl acrylate | 20.0 parts by mass |
| Acrylic acid | 10.0 parts by mass |
| Di-t-butyl peroxide (polymerization initiator) | 16.0 parts by mass |

In addition, into a four-neck flask equipped with a nitrogen inlet tube, a dehydration tube, a stirrer, and a thermocouple, the following monomers of the amorphous polyester resin were placed in the ratios shown below, and the resultant mixture was heated to 170° C. for dissolution.

| | |
|---|---|
| An adduct of bisphenol A with 2 moles of ethylene oxide | 59.1 parts by mass |
| An adduct of bisphenol A with 2 moles of propylene oxide | 281.7 parts by mass |
| Terephthalic acid | 63.9 parts by mass |
| Succinic acid | 48.4 parts by mass |

The mixture placed in the dropping funnel was added dropwise into the four-neck flask over 90 minutes while stirring, and the resultant mixture was aged for 60 minutes. After that, unreacted monomers were removed under reduced pressure (8 kPa). After that, 0.4 parts by mass of tetrabutyl orthotitanate $Ti(OBu)_4$ that is an esterification catalyst was charged, the mixture was heated up to 235° C., and the reaction was performed for 5 hours under atmospheric pressure (101.3 kPa) and for 1 hour under reduced pressure (8 kPa). Next, the mixture was cooled down to 200° C., the reaction was performed under reduced pressure (20 kPa), and then desolvation was performed to synthesize an amorphous polyester resin (a).

When the weight average molecular weight Mw and glass transition point Tg of the obtained amorphous polyester resin (a) were measured using the measurement method described in the above embodiment and further the acid value was measured, the weight average molecular weight Mw was 24000, the glass transition point Tg was 60° C., and the acid value was 16.2 mg KOH/g.

Preparation Example of Dispersion Liquid (A) of Amorphous Polyester Resin Fine Particles 108 parts by mass of the obtained amorphous polyester resin (a) was placed in 64 parts by mass of methyl ethyl ketone, and the resultant mixture was stirred at 70° C. for 30 minutes for dissolution. Next, into this solution, 3.4 parts by mass of a 25% by mass aqueous solution of sodium hydroxide (equivalent to a degree of neutralization of 63%) was added. Subsequently, this solution was placed in a reaction vessel equipped with a stirrer, and into the reaction vessel, while stirring, 210 parts by mass of water that had warmed to 70° C. was added dropwise over 70 minutes and mixed. In the middle of the dropwise addition, the liquid in the vessel became cloudy, and an emulsion uniformly emulsified after the whole amount dropwise addition was prepared. When the volume median diameter of oil droplets of the emulsion was measured with a laser diffraction type particle size distribution analyzer "LA-750 (manufactured by HORIBA, LTD.)", 60 nm was shown.

Next, while keeping the emulsion at 70° C., by using a diaphragm type vacuum pump "V-700" (manufactured by BUCHI Labortechnik AG), methyl ethyl ketone was removed by distillation by stirring for 3 hours under a reduced pressure of 15 kPa (150 mbar), and a dispersion liquid (A) of amorphous polyester resin fine particles (a solid content of 27% by mass) in which fine particles of an amorphous polyester resin (a) had been dispersed was prepared.

When the volume median diameter of the amorphous polyester resin fine particles in the dispersion liquid (A) was measured with the laser diffraction type particle size distribution analyzer described above, 64 nm was shown.

Synthesis Example of Hybrid Crystalline Polyester Resin (c1)

the following raw material monomers of an addition polymerization resin (styrene-acrylic resin) segment, containing a bireactive monomer, and a radical polymerization initiator were mixed in the ratios shown below, and the mixture was placed in a dropping funnel.

| | |
|---|---|
| Styrene | 40.0 parts by mass |
| n-Butyl acrylate | 16 parts by mass |
| Acrylic acid | 3.5 parts by mass |
| Di-t-butyl peroxide (radical polymerization initiator) | 8 parts by mass |

In addition, into a four-neck flask equipped with a nitrogen inlet tube, a dehydration tube, a stirrer, and a thermocouple, raw materials of a crystalline polyester polymerization segment, that is, the following monomers of polyvalent carboxylic acid and polyhydric alcohol were placed in the following ratios, and the resultant mixture was heated to 170° C. for dissolution.

| | |
|---|---|
| Tetradecanedioic acid | 440 parts by mass |
| Butanediol | 135 parts by mass |

Next, into the mixture, the raw material monomers of an addition polymerization resin (styrene-acrylic resin) was added dropwise over 90 minutes while stirring, the resultant mixture was aged for 60 minutes, and then unreacted addition polymerization monomers were removed under reduced pressure (8 kPa). Note that the amount of the monomers removed at this time was extremely minute amount relative to the raw material monomer ratio of the above resin.

After that, 0.8 part by mass of $Ti(OBu)_4$ was charged as an esterification catalyst, the mixture was heated up to 235° C., and the reaction was performed for 5 hours under atmospheric pressure (101.3 kPa) and for 1 hour under reduced pressure (8 kPa).

Further, the resultant preparation was cooled down to 200° C., and then the reaction was performed further for 1 hour under reduced pressure (20 kPa) to synthesize a hybrid crystalline polyester resin (c1).

When the state of the obtained hybrid crystalline polyester resin (c1) was observed, the crystalline polyester resin was graft-modified with the styrene-acrylic resin. In addition, when the ratio of the polymerization segment of resins (styrene-acrylic resin) other than the crystalline polyester resin to the whole amount of the obtained hybrid crystalline polyester resin (c1) (hereinafter, referred to as "hybrid ratio"), the number average molecular weight Mn, and the melting point Tm were measured, the hybrid ratio was 8% by mass, the number average molecular weight Mn was 9500, and the melting point Tm was 72° C.

Synthesis Example of Hybrid Crystalline Polyester Resins (c2) to (c4)

Three kinds of crystalline polyester resins (c2) to (c4) were synthesized in the similar manner as in the above-described synthesis example of crystalline polyester resin (c1) except that the amount of the raw material monomers of the addition polymerization resin (styrene-acrylic resin) segment was changed (see the following Table I).

The synthesis conditions of each of the above-described crystalline polyester resins (c1) to (c4) are summarized in the following Table I.

TABLE I

| Crystalline polyester resin No. | Styrene [parts by mass] | n-Butyl acrylate [parts by mass] | Acrylic acid [parts by mass] | Polymerization initiator (di-t-butyl peroxide) [parts by mass] | Hybrid ratio [% by mass] |
|---|---|---|---|---|---|
| c1 | 40 | 16 | 3.5 | 8 | 8 |
| c2 | 24 | 9 | 2.0 | 5 | 3 |
| c3 | 30 | 12 | 2.6 | 6 | 5 |
| c4 | 47 | 19 | 3.9 | 9 | 10 |

Synthesis Example of Crystalline Polyester Resin (c5)

| | |
|---|---|
| Tetradecanedioic acid | 440 parts by mass |
| Butanediol | 135 parts by mass |

The above-described raw material monomers of a polycondensation-based resin (crystalline polyester resin) segment was placed into a four-neck flask equipped with a nitrogen inlet tube, a dehydration tube, a stirrer, and a thermocouple, after replacing the inside of the reaction vessel with dry nitrogen gas, 0.1 part by mass of a polymerization initiator (di-t-butyl peroxide) was added, and the polymerization reaction was performed at 180° C. for 8 hours while stirring under a nitrogen gas flow. Further, into the reaction vessel, 0.2 part by mass of a polymerization initiator (di-t-butyl peroxide) was added, the temperature was raised to 220° C., the polymerization reaction was performed for 6 hours while stirring, and then the inside of the reaction vessel was depressurized to 20 kPa, and the reaction was performed under reduced pressure to synthesize a (non-hybrid) crystalline polyester resin (c5) without having any polymerization segments of other resins.

(Physical Properties of Crystalline Polyester Resins (c1) to (c5))

The number average molecular weight Mn and melting point Tm of the obtained five kinds of crystalline polyester resins (c1) to (c5) were measured using a measurement method described in the above embodiment.

The measurement results are summarized in the following Table II.

TABLE II

| Crystalline polyester resin No. | Number average molecular weight Mn | Melting point Tm [° C.] | Note |
|---|---|---|---|
| c1 | 9500 | 72 | Hybrid crystalline polyester resin |
| c2 | 8700 | 70 | Hybrid crystalline polyester resin |
| c3 | 8900 | 71 | Hybrid crystalline polyester resin |
| c4 | 9900 | 73 | Hybrid crystalline polyester resin |
| c5 | 8000 | 69 | Non-hybrid crystalline polyester resin |

Preparation Example of Dispersion Liquid (C1) of Crystalline Polyester Resin Fine Particles 108 parts by mass of the obtained crystalline polyester resin (c1) was stirred in 64 parts by mass of methyl ethyl ketone at 70° C. for 30 minutes for dissolution. Next, into this solution, 3.3 parts by mass of a 25% by mass aqueous solution of sodium hydroxide (equivalent to a degree of neutralization of 45%) was added. This solution was placed in a reaction vessel equipped with a stirrer, and into the reaction vessel, while stirring, 210 parts by mass of water that had been warmed to 70° C. was added dropwise over 70 minutes and mixed. In the middle of the dropwise addition, the liquid in the vessel became cloudy, and an emulsion uniformly emulsified after the whole amount dropwise addition was prepared. When the volume median diameter of oil droplets of the emulsion was measured with a laser diffraction type particle size distribution analyzer "LA-750 (manufactured by HORIBA, LTD.)", 58 nm was shown.

Next, while keeping the emulsion at 70° C., by using a diaphragm type vacuum pump "V-700" (manufactured by BUCHI Labortechnik AG), methyl ethyl ketone was removed by distillation by stirring for 3 hours under a reduced pressure of 15 kPa (150 mbar), and a dispersion liquid (C1) of crystalline polyester resin fine particles (a solid content of 24% by mass) in which fine particles of a crystalline polyester resin (c1) had been dispersed was prepared.

Preparation Example of Dispersion Liquids (C2) to (C6) of Crystalline Polyester Resin Fine Particles Dispersion liquids (C2) to (C6) of five kinds of crystalline polyester resin fine particles were prepared in the similar manner as in the preparation example of a dispersion liquid (C1) of crystalline polyester resin fine particles except that the kind of the crystalline polyester resin and the amount of the 25% by mass aqueous solution of sodium hydroxide were changed (see the following Table III).

The preparation conditions of each of the above-described dispersion liquids (C1) to (C6) of crystalline polyester resin fine particles are summarized in the following Table III.

TABLE III

| Dispersion liquid No. of crystalline polyester resin fine particles | Crystalline polyester resin No. | 25% by mass aqueous solution of sodium hydroxide [parts by mass] | Degree of neutralization [%] |
|---|---|---|---|
| C1 | c1 | 3.30 | 45 |
| C2 | c2 | 3.20 | 44 |
| C3 | c3 | 3.25 | 44.5 |
| C4 | c4 | 3.10 | 43 |
| C5 | c5 | 3.20 | 44 |
| C6 | c1 | 3.00 | 41 |

[Physical Properties of Dispersion Liquids (C1) to (C6) of Crystalline Polyester Resin Fine Particles]

The volume median diameter in each of the obtained dispersion liquids (C1) to (C6) of crystalline polyester resin fine particles were measured using a measurement method described in the above embodiment.

The measurement results are summarized in the following Table IV.

TABLE IV

| Dispersion liquid No. of crystalline polyester resin fine particles | Median diameter [nm] |
|---|---|
| C1 | 60 |
| C2 | 90 |
| C3 | 72 |
| C4 | 121 |
| C5 | 79 |
| C6 | 178 |

Preparation Example of Dispersion Liquid of Coloring Agent Fine Particles

Into a solution in which 90 parts by mass of sodium dodecyl sulfate had been added into 1600 parts by mass of ion exchanged water, while stirring the solution, 420 parts by mass of copper phthalocyanine (C.I. Pigment Blue 15:3) was gradually added. The resultant mixture was subjected to a dispersion treatment by using a stirring device CLEARMIX (manufactured by M Technique Co., Ltd., "CLEARMIX" is a registered trademark of the company), and a dispersion liquid of coloring agent fine particles was prepared.

When the volume median diameter of the coloring agent particles in the dispersion liquid was measured, 110 nm was shown.

Preparation Example of Dispersion Liquid (W) of Release Agent Fine Particles

| | |
|---|---|
| Behenyl behenate (release agent, melting point of 73° C.) | 100 parts by mass |

-continued

| | |
|---|---|
| Anionic surfactant (NEOGEN RK manufactured by Dai-ichi Kogyo Seiyaku Co., Ltd.) | 10 parts by mass |
| Ion exchanged water | 400 parts by mass |

The above-described materials were mixed and heated to 80° C., and thoroughly dispersed with ULTRA-TURRAX T50 manufactured by IKA Works GmbH & Co. KG. After that, the resultant preparation was subjected to a dispersion treatment with a pressure discharge-type Gaulin homogenizer, and then ion exchanged water was added into the dispersion liquid so that the solid component amount is 15%, and a dispersion liquid (W) of release agent fine particles was prepared. When the volume median diameter of the release agent particles in the dispersion liquid was measured with a laser diffraction type particle size distribution analyzer, LA-750 (manufactured by HORIBA, LTD.), 220 nm was shown.

(Preparation Example of Dispersion Liquid (S1) of Styrene-Acrylic Resin Fine Particles)

(First Stage Polymerization)

Into a 5 L volume reaction vessel equipped with a stirring device, a temperature sensor, a cooling pipe, and a nitrogen introduction device, 8 parts by mass of sodium dodecyl sulfate, and 3000 parts by mass of ion exchanged water were charged, and the internal temperature was raised to 80° C. while stirring the resultant mixture at a stirring speed of 230 rpm under a nitrogen stream. Into the resultant mixture after the temperature rise, a solution in which 10 parts by mass of potassium persulfate had been dissolved in 200 parts by mass of ion exchanged water was added, the liquid temperature was set to 80° C. again, and into the resultant mixture, a mixture of the following monomers was added dropwise over 1 hour.

| | |
|---|---|
| Styrene | 480.0 parts by mass |
| n-Butyl acrylate | 250.0 parts by mass |
| Methacrylic acid | 68.0 parts by mass |

After the dropwise addition of the mixture, by heating and stirring the resultant mixture at 80° C. for 2 hours, the polymerization of monomers was performed to prepare a dispersion liquid (s1) of styrene-acrylic resin particles.

(Second Stage Polymerization)

Into a 5 L volume reaction vessel equipped with a stirring device, a temperature sensor, a cooling pipe, and a nitrogen introduction device, 1100 parts by mass of ion exchanged water, and 55 parts by mass in terms of solid content of the dispersion liquid (s1) of styrene-acrylic resin particles, which had been prepared by the above first stage polymerization, were charged and heated to 87° C. After that, the mixture in which the following monomers, chain transfer agent, and release agent had been dissolved at 80° C. was mixed and dispersed for 10 minutes with a mechanical dispersing machine having a circulation pass, CLEARMIX (manufactured by M Technique Co., Ltd.), and a dispersion liquid containing emulsified particles (oil droplet) was prepared.

| | |
|---|---|
| Styrene (St) | 256.0 parts by mass |
| 2-Ethylhexyl acrylate (2-EHA) | 95.0 parts by mass |
| Methacrylic acid (MAA) | 30.0 parts by mass |

-continued

| | |
|---|---|
| n-Octyl-3-mercaptopropionate (chain transfer agent) | 3.9 parts by mass |
| Behenyl behenate (release agent, melting point of 73° C.) | 36.8 parts by mass |
| Microcrystalline (release agent, melting point of 80° C.) | 7.2 parts by mass |

Into the above-described 5 L volume reaction vessel, this dispersion liquid was added, and a solution of a polymerization initiator, in which 5.5 parts by mass of potassium persulfate had been dissolved in 100 parts by mass of ion exchanged water was added, the polymerization was performed by heating and stirring the system at 87° C. over 1 hour, and a dispersion liquid (s2) of styrene-acrylic resin particles was prepared.

(Third Stage Polymerization)

Into the dispersion liquid (s2) of styrene-acrylic resin particles, which was obtained by the above second stage polymerization, a solution in which 8 parts by mass of potassium persulfate had been dissolved in 140 parts by mass of ion exchanged water was further added, and further, under the temperature condition of 84° C., a mixture of the following monomers and chain transfer agent was added dropwise over 90 minutes.

| | |
|---|---|
| Styrene (St) | 367.2 parts by mass |
| n-Butyl acrylate (BA) | 165.0 parts by mass |
| Methacrylic acid (MAA) | 34.3 parts by mass |
| Methyl methacrylate (MMA) | 52.5 parts by mass |
| n-Octyl-3-mercaptopropionate | 8.0 parts by mass |

After the completion of the dropwise addition, the polymerization was performed by heating and stirring the resultant mixture over 2 hours, and then the resultant preparation was cooled down to 28° C. to prepare a dispersion liquid (S1) of styrene-acrylic resin fine particles.

(Production of Toner)

Using each of the raw materials obtained as described above, toners according to Examples 1 to 7 and Comparative Examples 1 to 9 were produced.

Note that since the toners according to Examples 1, 3, 5, and 7 and Comparative Examples 2, 5, 7, and 8, are different from the toners according to Examples 2, 4, and 6 and Comparative Examples 1, 3, 4, 6, and 9 in the resin to be used as the main component and the production method, at first, the production examples of the toners according to Examples 1, 3, 5, and 7 and Comparative Examples 2, 5, 7, and 8, in which a styrene-acrylic resin is used as the main component, will be described, and then the production examples of the toners according to Examples 2, 4, and 6 and Comparative Examples 1, 3, 4, 6, and 9, in which an amorphous polyester resin is used as the main component, will be described.

Production Example of Toner According to Example 1

Into a reaction vessel equipped with a stirring device, a temperature sensor, and a cooling pipe, 464.4 parts by mass (in terms of solid content) of a dispersion liquid (S1) of styrene-acrylic resin fine particles, and 284 parts by mass of ion exchanged water were charged. Into the resultant mixture, a 5 mol/L aqueous solution of sodium hydroxide was added to adjust the pH of the mixture solution to 10 at room temperature (25° C.). Further, 30 parts by mass (in terms of solid content) of a dispersion liquid of coloring agent fine particles was charged into the reaction vessel, 80 parts by mass of 50% by mass aqueous solution of magnesium chloride was added to the resultant mixture at 30° C. over 10 minutes under stirring. The mixture was left to stand for 3 minutes, and then the temperature was raised up to 80° C. over 60 minutes, and after reaching 80° C., 64.5 parts by mass (in terms of solid content) of a dispersion liquid (C1) of crystalline polyester resin fine particles was charged into the reaction vessel over 20 minutes, the stirring speed was adjusted so that the growth rate of the particles is 0.01 μm/min, and the particles were allowed to grow until the volume median diameter reached 6.0 μm as measured with Coulter Multisizer 3 (manufactured by Beckman Coulter, Inc.).

Next, 58.05 parts by mass (in terms of solid content) of a dispersion liquid (A) of amorphous polyester resin fine particles was charged into the reaction vessel over 30 minutes, and an aqueous solution prepared by dissolving 80 parts by mass of sodium chloride in 300 parts by mass of ion exchanged water was added to the mixture at the time point when the supernatant of the reaction mixture became transparent to stop the particle growth. Next, the mixture was stirred at 80° C., and the fusion of the particles was allowed to proceed until the average circularity of the toner particles became 0.970, and then the mixture was cooled at a temperature drop rate of 0.5° C./min or more to lower the liquid temperature down to 30° C. or less.

After that, while stirring the mixture, the temperature was raised up to 50° C. over 30 minutes, and the mixture was subjected to a heat treatment process for 3 hours. Subsequently, the mixture was cooled to lower the liquid temperature down to 30° C. or less. Next, solid and liquid separation was performed, the dehydrated toner cake was redispersed in ion exchanged water, and the solid-liquid separation was repeated three times for washing. After the washing, the resultant preparation was dried at 35° C. for 24 hours to produce toner particles. Into 100 parts by mass of the obtained toner particles, 0.6 part by mass of hydrophobic silica particles (number average diameter of primary particles: 12 nm, hydrophobicity degree: 68), 1.0 part by mass of hydrophobic titanium oxide particles (number average diameter of primary particles: 20 nm, hydrophobicity degree: 63), and 1.0 part by mass of sol-gel silica (number average diameter of primary particles: 110 nm) were added, and the resultant mixture was mixed at 32° C. for 20 minutes at a rotor blade peripheral speed of 35 mm/sec with Henschel Mixer (manufactured by NIPPON COKE & ENGINEERING CO., LTD.). After the mixing, coarse particles were removed using a sieve having a mesh opening of 45 μm to produce the toner according to Example 1.

Production Example of Toners According to Examples 3, 5, and 7 and Comparative Examples 2, 5, 7, and 8

The toners according to Examples 3, 5, and 7 and Comparative Examples 2, 5, 7, and 8 each were produced in the similar manner as in the above-described production example of the toner according to Example 1 except that the amounts of the dispersion liquid (S1) of styrene-acrylic resin fine particles and the dispersion liquid (A) of amorphous polyester resin fine particles, and the kind and amount of the dispersion liquid of crystalline polyester resin fine particles were changed (see Table V).

The production conditions of the above-described toners according to Examples 1, 3, 5, and 7, and Comparative Examples 2, 5, 7, and 8 are summarized in the following Table V.

TABLE V

| | Dispersion liquid of styrene-acrylic resin fine particles | Dispersion liquid of amorphous polyester resin fine particles | Dispersion liquid of crystalline polyester resin fine particles | |
|---|---|---|---|---|
| | [parts by mass] | [parts by mass] | No. | [parts by mass] |
| Example 1 | 464.40 | 58.05 | C1 | 64.50 |
| Example 3 | 451.50 | 58.05 | C1 | 77.40 |
| Example 5 | 464.40 | 58.05 | C5 | 64.50 |
| Example 7 | 457.95 | 74.18 | C3 | 54.83 |
| Comparative Example 2 | 425.70 | 99.98 | C1 | 61.28 |
| Comparative Example 5 | 490.20 | 51.60 | C3 | 45.15 |
| Comparative Example 7 | 445.05 | 58.05 | C3 | 83.85 |
| Comparative Example 8 | 393.45 | 85.14 | C6 | 108.36 |

Production Example of Toner According to Example 2

Into a reaction vessel equipped with a stirring device, a temperature sensor, and a cooling pipe, 238.65 parts by mass (in terms of solid content) of a dispersion liquid (A) of amorphous polyester resin fine particles, 63.8 parts by mass (in terms of solid content) of a dispersion liquid (W) of release agent fine particles, and 96.1 parts by mass of ion exchanged water were charged. Into the resultant mixture, a 5 mol/L aqueous solution of sodium hydroxide was added to adjust the pH of the mixture solution to 10 at room temperature (25° C.). Further, 30 parts by mass (in terms of solid content) of a dispersion liquid of coloring agent fine particles was charged into the reaction vessel, 42.7 parts by mass of 50% by mass aqueous solution of magnesium chloride was added to the resultant mixture at 30° C. over 10 minutes under stirring. The mixture was left to stand for 3 minutes, and then the temperature was raised up to 80° C. over 60 minutes, and after reaching 80° C., 180.6 parts by mass (in terms of solid content) of a dispersion liquid (C3) of crystalline polyester resin fine particles was charged into the reaction vessel over 20 minutes, the stirring speed was adjusted so that the growth rate of the particles is 0.01 μm/min, and the particles were allowed to grow until the volume median diameter reached 6.0 μm as measured with Coulter Multisizer 3 (manufactured by Beckman Coulter, Inc.).

Next, 167.7 parts by mass (in terms of solid content) of the dispersion liquid (s1) of styrene-acrylic resin particles, which had been obtained by performing only the above first stage polymerization, were charged into the reaction vessel over 30 minutes, and an aqueous solution prepared by dissolving 80 parts by mass of sodium chloride in 300 parts by mass of ion exchanged water was added to the mixture at the time point when the supernatant of the reaction mixture became transparent to stop the particle growth. Next, the resultant preparation was stirred in a state of 80° C., the fusion among the particles is allowed to proceed until the average circularity of the toner particles reaches 0.970, and then the mixture was cooled at a temperature drop rate of 0.5° C./min or more to lower the liquid temperature down to 30° C. or less.

After that, while stirring the mixture, the temperature was raised up to 50° C. over 30 minutes, and the mixture was subjected to a heat treatment process for 3 hours. Subsequently, the mixture was cooled to lower the liquid temperature down to 30° C. or less. Next, solid and liquid separation was performed, the dehydrated toner cake was redispersed in ion exchanged water, and the solid-liquid separation was repeated three times for washing. After the washing, the resultant preparation was dried at 40° C. for 24 hours to produce the toner particles. Into 100 parts by mass of the obtained toner particles, 0.6 part by mass of hydrophobic silica particles (number average diameter of primary particles: 12 nm, hydrophobicity degree: 68), 1.0 part by mass of hydrophobic titanium oxide particles (number average diameter of primary particles: 20 nm, hydrophobicity degree: 63), and 1.0 part by mass of sol-gel silica (number average diameter of primary particles: 110 nm) were added, and mixed at 32° C. for 20 minutes at a rotor blade peripheral speed of 35 mm/sec with Henschel Mixer (manufactured by NIPPON COKE & ENGINEERING CO., LTD.). After the mixing, coarse particles were removed using a sieve having a mesh opening of 45 μm to produce the toner according to Example 2.

Production Example of Toners According to Examples 4, and 6 and Comparative Examples 1, 3, 4, 6, and 9

The toners according to Examples 4, and 6 and Comparative Examples 1, 3, 4, 6, and 9 each were produced in the similar manner as in the production example of the toner according to Example 2 except that the amounts of the dispersion liquid (s1) of styrene-acrylic resin fine particles and the dispersion liquid (A) of amorphous polyester resin fine particles, and the kind and amount of the dispersion liquid of crystalline polyester resin fine particles were changed (see the following Table VI).

The production conditions of the above-described toners according to Examples 2, 4, and 6, and Comparative Examples 1, 3, 4, 6, and 9 are summarized in the following Table VI.

TABLE VI

| | Dispersion liquid of styrene-acrylic resin fine particles | Dispersion liquid of amorphous polyester resin fine particles | Dispersion liquid of crystalline polyester resin fine particles | |
|---|---|---|---|---|
| | [parts by mass] | [parts by mass] | No. | [parts by mass] |
| Example 2 | 167.70 | 238.65 | C3 | 180.60 |
| Example 4 | 148.35 | 258.00 | C1 | 180.60 |
| Example 6 | 167.70 | 238.65 | C4 | 180.60 |
| Comparative Example 1 | 0 | 348.30 | C5 | 238.65 |
| Comparative Example 3 | 167.70 | 161.25 | C2 | 258.00 |
| Comparative Example 4 | 32.25 | 322.50 | C1 | 232.20 |
| Comparative Example 6 | 77.40 | 303.15 | C3 | 206.40 |
| Comparative Example 9 | 32.25 | 361.20 | C5 | 193.50 |

In addition, for all of the obtained toners, the volume median diameter of crystalline polyester resin, the ratio of the crystalline polyester resin to the total amount of the amorphous polyester resin and the crystalline polyester resin, the melting point Tm, the temperature at which a storage modulus before heat left G' before being left to stand becomes $1.0\times10^8$ Pa, the storage modulus after heat left G', the hybrid ratio, and the like were measured. The properties and the like of all of the obtained toners are summarized in the following Table VII. Note that the value of the storage modulus after heat left in Table is a value at a temperature of X'° C. at which a value of the ratio of the storage modulus after heat left G' at a temperature of X° C. after being left to stand at the temperature of X° C. for 2 hours to the storage modulus before heat left G' at the temperature of X° C. becomes the maximum, and was determined by performing the following (1) to (9).

(1) Under an environment of a temperature of 20° C. and a humidity of 50%, 0.2 g of each of the above-described various toners is weighed and placed in a cylinder, a pressure of 25 MPa is applied to the toners by a compression molding machine to perform pressure molding, and cylindrical pellets each having a diameter of 10 mm, which is used as measurement samples, are prepared.

(2) The temperature of a measurement part of a rheometer (ARES G2 manufactured by TA Instruments) is set to 100° C., and a prepared pellet is sandwiched between a pair of upper and lower parallel plates of the measurement part. At this time, the upper parallel plate is set to 8 mm in diameter, and the lower parallel plate is set to 20 mm in diameter.

(3) The parallel plate gap is once set to 1.4 mm, and then a part of the measurement sample, which protruded from between the plates, is scraped off, and the parallel plate gap is set to 1.2 mm.

(4) The temperature of the measurement part is lowered to 30° C. that is a measurement starting temperature.

(5) While applying a sinusoidal oscillation of 1 Hz to the pellet from the lower parallel plate, the temperature of the measurement part is raised from 30° C. to 150° C. at a temperature rise rate of 3° C./min, and changes in the storage modulus before heat left G' are measured, and the obtained measurement results are plotted in a graph.

(6) The above (1) to (3) are performed again.

(7) The pellet sandwiched between the parallel plates is cooled down to 40° C. while applying a predetermined axial force, and left to stand for 2 hours.

(8) The temperature of the measurement part is lowered down to 30° C. that is the measurement starting temperature.

(9) While applying a sinusoidal oscillation of 1 Hz to the pellet from the lower parallel plate, the temperature of the measurement part is raised from 30° C. to 150° C. at a temperature rise rate of 3° C./min, changes in the storage modulus after heat left G' are measured, and plotted in a graph.

(10) In the similar manner as in the above (5) to (7) except that the leaving temperature was changed from 40° C. to 60° C. in increments of 2.5° C., the relationship between the temperature and the storage modulus after heat left G' is sequentially plotted in a graph.

(11) From the obtained graph of the storage modulus before heat left G' and multiple graphs of the storage modulus after heat left G', the storage modulus before heat left G' and storage modulus after heat left G' at the leaving temperature when the graph was obtained are determined, respectively, and a value of the ratio [storage modulus after heat left G'/storage modulus before heat left G'] is calculated.

(12) The obtained multiple calculation results are plotted on a graph with the leaving temperature on the X axis and the value of the ratio on the Y axis, a leaving temperature X'° C. at which the value of the ratio [storage modulus after heat left G'/storage modulus before heat left G'] becomes the maximum is calculated from the plots, and the storage modulus after heat left G' at that time is specified.

Note that the detailed measurement conditions of the storage modulus G' are as follows.

Frequency: 1 Hz

Temperature rise rate: 3° C./min

Axial force: 0 g, sensitivity: 10 g

Initial strain: 3.0%, strain adjustment: 30.0%, minimum strain: 0.01%, maximum strain: 10.0%

Minimum torque: 1 g·cm, maximum torque: 80 g·cm

Sampling interval: 1.0° C./pt

TABLE VII

| | Composition ratio | | | | CPEs | | | Temperature at which a storage | Storage | | |
|---|---|---|---|---|---|---|---|---|---|---|---|
| | Styrene-acrylic resin [% by mass] | APEs [% by mass] | CPEs [% by mass] | Release agent [% by mass] | Median diameter [nm] | Ratio [% by mass] | Melting point Tm [° C.] | modulus before heat left becomes $1.0\times10^8$ Pa [° C.] | modulus after heat left [Pa] | CPEs hybrid ratio [% by mass] | Temperature drop rate in cooling [° C./min] |
| Example 1 | 72 | 9 | 10 | 9 | 60 | 52.6 | 71 | 52 | $3.8\times10^8$ | 8 | 1.5 |
| Example 2 | 26 | 37 | 28 | 9 | 60 | 43.1 | 64 | 48 | $3.8\times10^8$ | 5 | 1.5 |
| Example 3 | 70 | 9 | 12 | 9 | 121 | 57.1 | 67 | 50 | $2.6\times10^8$ | 8 | 1.5 |
| Example 4 | 23 | 40 | 28 | 9 | 60 | 41.2 | 62 | 46 | $1.1\times10^8$ | 8 | 1.2 |
| Example 5 | 72 | 9 | 10 | 9 | 72 | 52.6 | 74 | 54 | $4.2\times10^8$ | 0 | 1.0 |
| Example 6 | 26 | 37 | 28 | 9 | 92 | 43.1 | 59 | 46 | $1.7\times10^8$ | 10 | 1.5 |
| Example 7 | 71 | 11.5 | 8.5 | 9 | 60 | 42.5 | 76 | 55 | $4.8\times10^8$ | 5 | 0.8 |
| Comparative Example 1 | 0 | 54 | 37 | 9 | 92 | 40.7 | 61 | 46 | $1.6\times10^8$ | 0 | 1.0 |
| Comparative Example 2 | 66 | 15.5 | 9.5 | 9 | 121 | 38.0 | 70 | 52 | $3.6\times10^8$ | 8 | 1.5 |
| Comparative Example 3 | 26 | 25 | 40 | 9 | 90 | 61.5 | 61 | 47 | $1.4\times10^8$ | 3 | 1.2 |
| Comparative Example 4 | 5 | 50 | 36 | 9 | 121 | 41.9 | 62 | 42 | $1.2\times10^8$ | 8 | 1.1 |
| Comparative Example 5 | 76 | 8 | 7 | 9 | 60 | 46.7 | 74 | 57 | $3.6\times10^8$ | 5 | 1.5 |

TABLE VII-continued

| | Composition ratio | | | | CPEs | | | Temperature at which a storage modulus before heat left becomes $1.0 \times 10^8$ Pa [° C.] | Storage modulus after heat left [Pa] | CPEs hybrid ratio [% by mass] | Temperature drop rate in cooling [° C./min] |
|---|---|---|---|---|---|---|---|---|---|---|---|
| | Styrene-acrylic resin [% by mass] | APEs [% by mass] | CPEs [% by mass] | Release agent [% by mass] | Median diameter [nm] | Ratio [% by mass] | Melting point Tm [° C.] | | | | |
| Comparative Example 6 | 12 | 47 | 32 | 9 | 60 | 40.5 | 63 | 46 | $0.91 \times 10^8$ | 3 | 1.0 |
| Comparative Example 7 | 69 | 9 | 13 | 9 | 60 | 59.1 | 72 | 55 | $5.4 \times 10^8$ | 5 | 1.2 |
| Comparative Example 8 | 61 | 13.2 | 16.8 | 9 | 170 | 56.0 | 64 | 47 | $0.95 \times 10^8$ | 8 | 0.3 |
| Comparative Example 9 | 5 | 56 | 30 | 9 | 60 | 34.9 | 60 | 43 | $1.8 \times 10^8$ | 0 | 1.5 |

APEs: amorphous polyester resin
CPEs: crystalline polyester resin

<Evaluation of Toner>

For each of the toners obtained as described above, three kinds of properties of the low temperature fixability, the heat-resistant storability, and the gloss memory development were tested, respectively.

[Evaluation of Low Temperature Fixability]

Using a commercially available full-color multifunction machine "bizhub PRESS C1070" (manufactured by KONICA MINOLTA, INC.) as the image forming device, an unfixed solid image (toner adhesion amount of 11.3 g/m$^2$) was formed on mondi Color Copy (having a basis weight of 90 g/m$^2$) of A4 size manufactured by mondi under an environment of room temperature and normal humidity (temperature of 20° C., and humidity of 50% RH). Next, the surface temperature of a pressure roller of a fixing device was set to 100° C., and the fixing was performed by changing the surface temperature of the fixing roller in the range of 130 to 170° C. in increments of 2° C. The fixing temperature at the time when the image stain due to fixing offset was no longer visually confirmed was set as the lowest fixing temperature, and the evaluation was performed in accordance with the following evaluation criteria.

—Evaluation Criteria—

A: less than 135° C.: excellent in the low temperature fixability

B: 135° C. or more and less than 150° C.: no problem in practical use

C: 150° C. or more and less than 155° C.: usable by controlling the fixing process D: 155° C. or more: not fixed sufficiently at the target paper feed speed, and there is a problem in practical use A, B, and C are acceptable levels.

[Evaluation of Heat-Resistant Storability]

For each of the obtained toners, respectively, 0.5 g of toner was taken into a 10 mL glass bottle having an inner diameter of 21 mm, the lid was closed, and the glass bottle was shaken 600 times at room temperature using a shaking machine "Tap Denser KYT-2000" (manufactured by SEISHIN ENTERPRISE Co., Ltd). After that, the resultant preparation was left to stand for 2 hours in a state where the lid was opened under an environment of a temperature of 55° C. and a humidity of 35% RH. Next, the toner was carefully placed on a 48-mesh sieve (mesh opening of 350 μm) so that the aggregate of the toner is not crushed, and the sieve was set in "Powder Tester" (manufactured by Hosokawa Micron Corporation), and fixed with a pressing bar and a knob nut. The vibration intensity was adjusted to have a feed width of 1 mm, vibration was applied for 10 seconds, and then the ratio (mass %) of the amount of the toner remaining on the sieve was measured, and the toner aggregation ratio was calculated by the following equation (A).

$$\text{toner aggregation ratio \%} = (\text{residual toner mass on sieve g})/0.5\ \text{g} \times 100) \quad \text{Equation (A):}$$

Similar measurements were performed at temperatures of 57.5° C., and 60° C., respectively, and the measurement results were plotted on a graph with the temperature on the X axis and the toner aggregation ratio on the Y axis. An approximate straight line was drawn between two temperatures sandwiching a region where the toner aggregation ratio becomes 50% among the temperatures 55° C., 57.5° C., and 60° C., a temperature at which the toner aggregation ratio becomes 50% was calculated from the interpolation, and the evaluation was performed in accordance with the following evaluation criteria.

—Evaluation Criteria—

A: 59° C. or more

B: 58° C. or more and less than 59° C.

C: 57° C. or more and less than 58° C.

D: less than 57° C.

A, B, and C are acceptable levels.

[Evaluation of Gloss Memory Development]

Figure 2B:
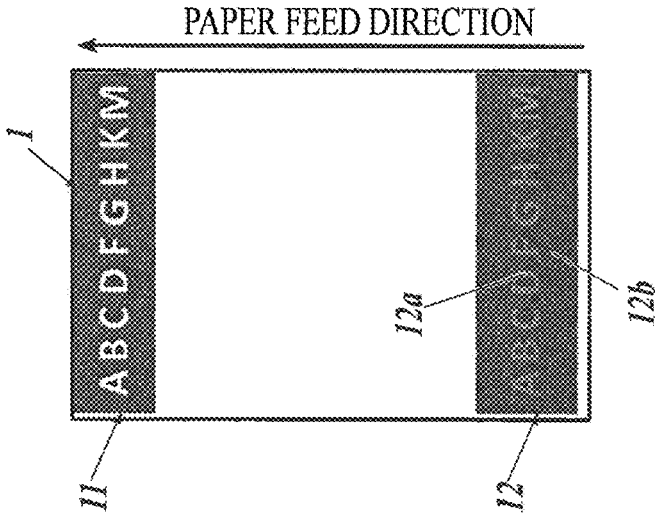
FIG. 2A and FIG. 2B is an image printed to examine the development of gloss memory.
Figure 2A:
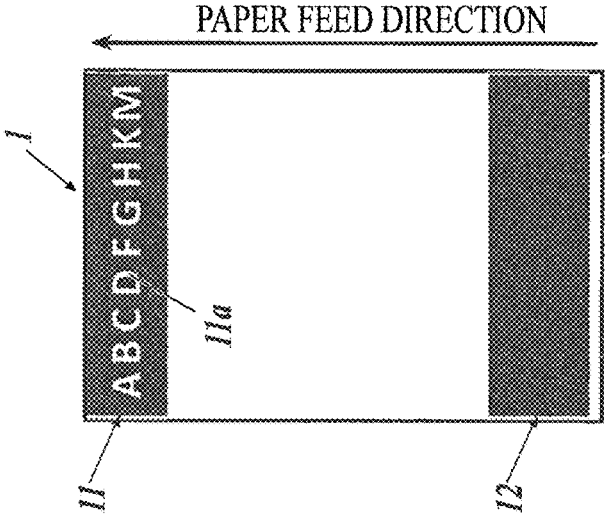

Using a commercially available full-color multifunction machine "bizhub PRESS C1070" (manufactured by KONICA MINOLTA, INC.) as the image forming device, an image (toner adhesion amount of 8.0 g/m$^2$) as shown in FIG. 2A was printed on Esprit 1 (having a basis weight of 209 g/m$^2$) of A3 size manufactured by NIPPON PAPER INDUSTRIES CO., LTD. under an environment of room temperature and normal humidity (temperature of 20° C., and humidity of 50% RH). Next, the surface temperature of a pressure roller of a fixing device was set to 100° C., the surface temperature of the fixing roller was set to a sum of an under offset elimination temperature, at which the under offset is eliminated, and 25° C., and the fixing was performed. The under offset is an image defect that toner is peeled off from a transfer medium due to insufficient melting of the toner, and hereinafter referred to as "UO".

Figure 3:
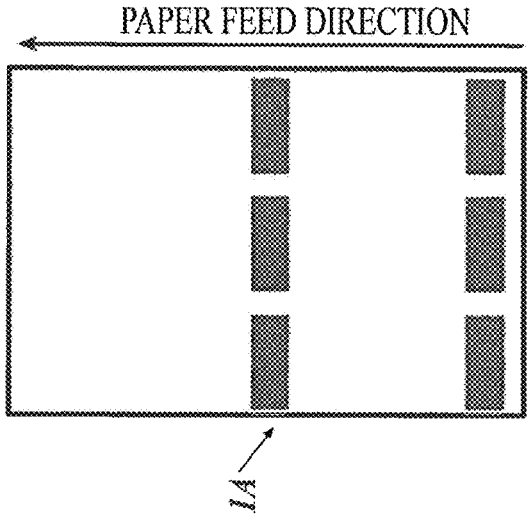
FIG. 3 is an image printed to examine the temperature for eliminating under offset.

The UO elimination temperature was calculated as follows. Specifically, using a commercially available full-color multifunction machine "bizhub PRESS C1070" (manufactured by KONICA MINOLTA, INC.) as the image forming device, under an environment of room temperature and normal humidity (temperature of 20° C., and humidity of 50% RH), an image (toner adhesion amount of 11.3 g/m$^2$)

being multiple filled rectangles that are arranged each in a central part, and in an end part on the opposite side of the moving direction (hereinafter, referred to as "paper feed direction") in the image forming device, of Esprit 1A (having a basis weight of 209 g/m$^2$) of A3 size manufactured by NIPPON PAPER INDUSTRIES CO., LTD., was printed on the Esprit 1A, as shown in FIG. 3. Next, the surface temperature of a pressure roller of a fixing device was set to 100° C., and the fixing of toner was performed by changing the surface temperature of the fixing roller in the range of 130 to 170° C. in increments of 2° C. The surface temperature of the fixing roller when the image stain due to UO was no longer visually confirmed in the end part on the opposite side of the paper feed direction of Esprit 1A was taken as the UO elimination temperature.

As shown in FIG. 2A, the image to be printed was an image of filled rectangles at each of both ends in the paper feed direction of Esprit 1, and the image in the end part on the traveling direction side of Esprit 1 had white letters in the filled rectangle. Hereinafter, the image in the end part on the feed direction side is referred to as a front solid part 11, white letters in the image are referred to as a white letter part 11*a*, and the image in the end part on the opposite side of the paper feed direction is referred to as a back solid part 12.

The distance between the end of the front solid part 11 in the paper feed direction and the end of the back solid part 12 in the paper feed direction was set to be almost the same as the length of one turn of the circumferential surface of the fixing roller. That is, the distance was set to be a distance with which the part on the surface of the fixing roller, which was in contact with the front solid part 11, is in contact with the back solid part 12 after one turn of the fixing roller.

Here, the generation principle of the gloss memory will be described.

When the front solid part 11 is fixed, since the toner of the front solid part 11 exists around the white letter part 11*a*, a release agent is discharged from the toner, and some of the release agent adheres to the part on the surface of the fixing roller, which was in contact with the toner. On the other hand, since there is no toner in the white letter part 11*a*, adhesion of the release agent to the part of the fixing roller, which was in contact with the white letter part 11*a*, does not occur.

The part on the surface of the fixing roller, which was in contact with the front solid part 11, comes into contact also with the back solid part 12 after one turn of the fixing roller.

Herein, if the toner used for printing is a toner having insufficient discharge of the release agent, the separability between the fixing roller and the back solid part 12 is poor, therefore, some of the toner formed the back solid part 12 adheres to the fixing roller side. As a result, the surface of the image becomes rough, and the gloss decreases. Since the back solid part 12 is in contact with both of the part on the surface of the fixing roller, to which the release agent slightly adhered, and the part to which the release agent does not adhere at all, therefore, as shown in FIG. 2B, a part where roughness is large (less glossy) with a letter shape, and a part where the roughness around the above part is small (relatively high glossy) are generated. Hereinafter, in the back solid part in FIG. 2B, a part where the roughness is large and the gloss is low is referred to as a memory part 12*a*, and a part where the roughness is small and the gloss is high is referred to as a non-memory part 12*b*.

On the other hand, if the toner used for printing is a toner capable of sufficiently discharging the release agent, the back solid part 12 is easily separated from the fixing roller only by the release agent discharged from the toner of the back solid part 12 irrespective of which part of the surface of the fixing roller the back solid part 12 is in contact with. For this reason, the back solid part 12 has a uniform gloss with no roughness.

The degree of the visibility of the memory part 12*a*, which can be caused by the principle as described above, was visually confirmed, and the evaluation was performed in accordance with the following evaluation criteria.

—Evaluation Criteria—

A: Not visible at all

B: Outline is observed to be blurred

C: Slightly visible overall

D: Visible clearly

A, B, and C are acceptable levels.

In the test of the low temperature fixability, the toners according to Examples 1, 2, 4, and 6 and Comparative Examples 1, 3, 4, 6, and 9 were excellent A (the lowest fixing temperature of less than 135° C.), the toners according to Examples 3, and 5 and Comparative Example 8 had no problem in practical use B (135° C. or more and less than 150° C.), and the toner according to Example 7 was allowable C (150° C. or more and less than 155° C.), and these toners were evaluated as acceptable.

On the other hand, the toners according to Comparative Examples 2, 5, and 7 had a problem in practical use D (the lowest fixing temperature of 155° C. or more), and were evaluated as unacceptable.

Further, in the test of the heat-resistant storability (a temperature at which the toner aggregation ratio becomes 50%), the toners according to Examples 1 to 3, 5, and 7 and Comparative Examples 2, 5, and 7 were A (59° C. or more), the toner according to Example 4 was B (58° C. or more and less than 59° C.), and the toners according to Example 6 and Comparative Examples 1, and 9 were C (57° C. or more and less than 58° C.), and these toners were evaluated as acceptable.

On the other hand, the toners according to Comparative Examples 3, 4, 6, and 8 had a temperature, at which the toner aggregation ratio becomes 50%, of less than 57° C. (D), and were evaluated as unacceptable.

In addition, in the test of the gloss memory development, the toners according to Examples 1 to 3, 5, and 6 and Comparative Examples 2, and 8 were A (not visible at all), the toners according to Example 7 and Comparative Examples 3, 5, and 7 were B (outline is observed to be blurred), and the toners according to Example 4 and Comparative Example 6 were C (slightly visible overall), and these toners were evaluated as acceptable.

On the other hand, the toners according to Comparative Examples 1, 4, and 9 were D (Visible clearly), and evaluated as unacceptable.

The various test results in the above are summarized in the following Table VIII.

TABLE VIII

| | Low temperature fixability | | Heat-resistant storability | | Heat-leaving | Evaluation of gloss |
|---|---|---|---|---|---|---|
| | Temperature [° C.] | Evaluation | Temperature [° C.] | Evaluation | temperature [° C.] | memory development |
| Example 1 | 134 | A | 59.2 | A | 56 | A |
| Example 2 | 133 | A | 59.0 | A | 55 | A |

TABLE VIII-continued

| | Low temperature fixability | | Heat-resistant storability | | Heat-leaving | Evaluation of gloss |
|---|---|---|---|---|---|---|
| | Temperature [° C.] | Evaluation | Temperature [° C.] | Evaluation | temperature [° C.] | memory development |
| Example 3 | 140 | B | 59.0 | A | 54 | A |
| Example 4 | 132 | A | 58.0 | B | 55 | C |
| Example 5 | 143 | B | 59.7 | A | 58 | A |
| Example 6 | 132 | A | 57.5 | C | 58 | A |
| Example 7 | 152 | C | 59.0 | A | 60 | B |
| Comparative Example 1 | 130 | A | 57.1 | C | 56 | D |
| Comparative Example 2 | 155 | D | 59.2 | A | 55 | A |
| Comparative Example 3 | 133 | A | 56.7 | D | 57 | B |
| Comparative Example 4 | 130 | A | 56.0 | D | 55 | D |
| Comparative Example 5 | 157 | D | 60.0 | A | 59 | B |
| Comparative Example 6 | 131 | A | 56.5 | D | 58 | C |
| Comparative Example 7 | 156 | D | 59.5 | A | 60 | B |
| Comparative Example 8 | 138 | B | 56.3 | D | 55 | A |
| Comparative Example 9 | 132 | A | 57.0 | C | 55 | D |

All of the toners according to Examples 1 to 7 were evaluated as acceptable (C or more) in all of the three tests, but even though the toners according to Comparative Examples 1 to 8 were evaluated as acceptable in up to two tests in the three tests, none of the toners were evaluated as acceptable in all of the three tests.

Moreover, the toners according to Examples 3 to 7 were evaluated as B or C in one or two tests, but the toners according to Examples 1, and 2, which satisfy all of the preferred conditions, were evaluated to be the best (A) in all of the tests.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2017-017189, filed on Feb. 2, 2017, is incorporated herein by reference in its entirety.

What is claimed is:

1. An electrostatic charge image developing toner, at least comprising:

an amorphous polyester resin, a crystalline polyester resin, and a styrene-acrylic resin, as a binder resin; and a release agent, wherein a ratio of the crystalline polyester resin to the total amount of the amorphous polyester resin and the crystalline polyester resin is within a range exceeding 40% by mass to 60% by mass, a temperature at which a storage modulus before heat left G' before being left to stand at a temperature of X° C. becomes $1.0\times10^8$ Pa is within a range exceeding 45° C. to 55° C., and a storage modulus after heat left G' at a temperature of X'° C. at which a value of a ratio of the storage modulus after heat left G' at a temperature of X° C. after being left to stand at the temperature of X° C. for 2 hours to the storage modulus before heat left G' at the temperature of X° C. becomes the maximum is within a range of $1.0\times10^8$ to $5.0\times10^8$ Pa.

2. The electrostatic charge image developing toner according to claim 1, wherein the ratio of the crystalline polyester resin to the total amount of the amorphous polyester resin and the crystalline polyester resin is 42% by mass or more.

3. The electrostatic charge image developing toner according to claim 1, wherein a ratio of the styrene-acrylic resin to the whole amount of the binder resin is larger than 25% by mass.

4. The electrostatic charge image developing toner according to claim 1, wherein the storage modulus after heat left G' at the temperature of X° C. is larger than the storage modulus before heat left G' at the temperature of X° C.

5. The electrostatic charge image developing toner according to claim 1, wherein the crystalline polyester resin is a hybrid crystalline polyester resin formed by bonding a crystalline polyester polymerization segment and a polymerization segment of another resin.

6. The electrostatic charge image developing toner according to claim 5, wherein a ratio of the polymerization segment of another resin to the whole amount of the hybrid crystalline polyester resin is within a range of 1 to 10% by mass.

7. The electrostatic charge image developing toner according to claim 1, wherein a melting point Tm of a crystalline resin containing the crystalline polyester resin and the release agent is within a range of 60 to 75° C.

8. The electrostatic charge image developing toner according to claim 1, wherein a volume median diameter of the crystalline polyester resin is within a range of 40 to 150 nm.

* * * * *